US007083043B2

(12) United States Patent
Sharon

(10) Patent No.: US 7,083,043 B2
(45) Date of Patent: Aug. 1, 2006

(54) MULTI-COMPARTMENT CONTAINER ASSEMBLY SYSTEM

(75) Inventor: Igal Sharon, Caesaria (IL)

(73) Assignee: UC Technologies & Engineering Ltd., Budapest (HU)

( * ) Notice: Subject to any disclaimer, the term of this patent is extended or adjusted under 35 U.S.C. 154(b) by 47 days.

(21) Appl. No.: 10/214,374

(22) Filed: Aug. 6, 2002

(65) Prior Publication Data

US 2003/0024830 A1 Feb. 6, 2003

Related U.S. Application Data

(60) Provisional application No. 60/310,414, filed on Aug. 6, 2001.

(51) Int. Cl.
*B65D 25/08* (2006.01)
*A61J 9/00* (2006.01)

(52) U.S. Cl. ..... 206/221; 206/568; 206/219; 215/DIG. 8; 215/11.4; 222/129

(58) Field of Classification Search ..... 206/219–222, 206/568; 215/DIG. 8; 222/129, 130; 604/416
See application file for complete search history.

(56) References Cited

U.S. PATENT DOCUMENTS

| | | | | |
|---|---|---|---|---|
| 2,786,769 | A | 3/1957 | Greenspan | |
| 4,779,722 | A * | 10/1988 | Hall | 206/221 |
| 4,823,946 | A | 4/1989 | Stoeffler et al. | 206/221 |
| 5,000,314 | A | 3/1991 | Fuller et al. | 206/221 |
| 5,277,303 | A | 1/1994 | Goyet et al. | 206/221 |
| 5,348,060 | A | 9/1994 | Futagawa et al. | 141/100 |
| 5,564,600 | A | 10/1996 | Renault | 222/129 |
| 5,638,968 | A * | 6/1997 | Baron et al. | 215/11.4 |
| 5,692,644 | A | 12/1997 | Gueret | 222/80 |
| 5,875,888 | A * | 3/1999 | Albisetti | 206/221 |
| 5,875,889 | A * | 3/1999 | Albisetti | 206/221 |
| 5,992,693 | A | 11/1999 | Albisetti | |
| 6,021,892 | A * | 2/2000 | Baudin | 206/221 |
| 6,045,254 | A | 4/2000 | Inbar et al. | |
| 6,481,571 | B1 * | 11/2002 | Kelders et al. | 206/219 |
| 6,543,645 | B1 * | 4/2003 | Lacout | 222/129 |

FOREIGN PATENT DOCUMENTS

| | | |
|---|---|---|
| FR | 2.102.438 | 4/1992 |
| FR | 2.129.079 | 10/1992 |
| WO | WO 99/30669 | 6/1999 |

OTHER PUBLICATIONS

PCT International Search Report, 864/16, PCT/IL 02/00640, M.L.I.S. Projects Ltd., 3 pages.

* cited by examiner

*Primary Examiner*—Jila M. Mohandesi
(74) *Attorney, Agent, or Firm*—Mark M. Friedman

(57) ABSTRACT

A container assembly system for storing multiple components of a formulation in separate individual container assembly units (10, 30, 30', 130, 130', 230, 230') that can be assembled easily into a single multi-compartment container. The components of a formulation may be stored in each assembly units (10, 30, 30', 130, 130', 230, 230') and then assembled into a m can be mixed into a formula just prior to use. The assembly units, each containing a component of a formulation, can also be assembled into a single multi-compartment container first and then stored until ready for use.

10 Claims, 22 Drawing Sheets

MULTI-COMPARTMENT CONTAINER ASSEMBLY SYSTEM

This application claims benefit of U.S. Provisional Application No. 60/310,414, filed on Aug. 6, 2001.

FIELD OF THE INVENTION

This invention relates to a multi-compartment container assembly system for storing each of two or more components of a formulation separately in individual containers until ready for mixing prior to use.

SUMMARY OF THE INVENTION

The container assembly system of the present invention provides a container system that allows the user to store multiple components of a formulation in separate individual containers that can be assembled easily into a single multi-compartment container which can store the multiple components separated until they are ready for use at which time the components may then be mixed to form the formulation just prior to use. The container assembly system may consist of two basic types of assembly units: a dispensing unit, and a cartridge unit. Each of these units are separate containers that may be assembled together readily to form a single multi-compartment container with each of the assembly units forming a separate compartment.

For example, a dispensing unit and a cartridge unit may be assembled together to form a two-compartment container system. And by piggy-backing one or more cartridge units to the first cartridge unit in series, additional compartments may be added. Each additional cartridge unit may contain a different component of a formulation in any predetermined quantity. Furthermore, a multi-compartment container may be assembled by connecting multiple cartridge units only without using any dispensing unit. In such embodiment a suitable dispensing device may be attached to the top opening of the first cartridge unit if necessary.

It is to be appreciated that because the number and size of the dispensing unit and the cartridge units may be varied in unlimited combinations, this assembly system provides the flexibility of allowing the user to prepare varying quantities of a given formulation as well as to prepare a complex formulation with multiple components of varying quantities. Each of the assembly units may be provided in various sizes to accommodate different quantities of each component of a formulation where appropriate.

Another advantage of using the multi-compartment container system of this invention over the prior art multi-compartment containers is that the system provides longer storage-life for the components of a formulation and in most applications there is no need for special storage conditions of the system and/or components such as refrigeration. Because each component of a multi-component formulation may be stored in separately sealed containers, the components of a formulation may be stored for a longer periods without concerns of accidental mixing.

A dispensing unit may be a container for storing a component of a formulation with an opening at each end of the container body. The bottom end of the dispensing unit may be adapted and configured to engage a cartridge unit in order to assemble a multi-compartment container. The top end of the dispensing unit may be adapted and configured to engage a dispensing device such as a nozzle or a nipple of a suitable material for a baby feeding bottle, or a dosage device, etc. As will be later disclosed herein, the cartridge unit may be adapted and configured to engage the top or bottom ends of the dispensing unit.

Both ends of the dispensing unit may typically be sealed so that the dispensing unit's content can be protected from any contamination during storage. And because these seals must be removed in order to assemble the multi-compartment assembly and dispense the contents, the seals are preferably configured to be readily removed or broken, e.g., a breakable or peelable seal. The breakable or peelable seal may comprise a membrane where the membrane may be a foil or a non-metallic membrane, such as a plastic or other polymer membrane, and may have a single-layer or a multi-layered laminate structure. Such membrane seal may be heat sealed along the rims of the dispensing unit's open ends so that it may be peeled off to engage a cartridge unit or to attach an appropriate dispensing system. The seal may further comprise a screw-on or pressure closing cap.

A cartridge unit is another container for storing another component of the formulation with an opening at each of its top and bottom ends of the container. The top open end of the cartridge unit may be adapted and configured to sealingly engage the bottom opening of the dispensing unit in order to assemble a two-compartment container. To form a two-compartment container, the top end of the cartridge unit is inserted into the flange portion of the dispensing unit thereby each assembly units form a separate compartment of the resulting container. To form the seal between the assembly units, the outer surfaces near the top open end of the cartridge unit may be provided with one or more sealing ridges. The sealing ridges form fluid-tight seals with the inside wall surfaces of the bottom opening of the dispensing unit when the cartridge unit is inserted into the bottom opening of the dispensing unit.

The top open end of the cartridge unit also may be provided with a joining sleeve that is provided with one or more additional sealing ridges that engages the bottom opening of the dispensing unit.

Within the cartridge unit is provided a sealing wall that forms a fluid-tight seal at or near the top open end of the cartridge unit, sealing the top open end. The sealing wall is movable between a sealed position, whereby the seal is formed, and an unsealed position, whereby the inside of the cartridge unit is in flow-communication with the dispensing unit through the top open end.

The cartridge unit further may be provided with a displaceable member to move the sealing wall from its sealed position to its unsealed position. In addition, or alternatively, the displaceable member may move the sealing wall to its sealed position. The sealing wall may be provided at one end of the displaceable member and a manipulable portion may be provided at the other end.

The bottom open end of the cartridge unit may be adapted and configured to securely hold the displaceable member in the sealed position until the sealing wall has to be moved to the unsealed position in order to mix the contents of the cartridge unit thus functioning as a security mechanism for preventing unintentional unsealing of the sealing wall.

Displaceable member has the sealing wall at top end and a sealable filling opening near the bottom open end. Additional cartridge units may be piggy-backed to the bottom end of the displaceable member in series to form a multi-compartment container. In this configuration, the bottom end of the displaceable member of the first cartridge unit and the top end of the second cartridge unit engage each other to form a fluid-tight seal so that each cartridge unit may form a compartment of a multi-compartment container.

In one embodiment of the invention, a multi-compartment container assembly system has a dispensing unit having a housing and an opening at each of its top and bottom ends. The bottom end of the dispensing unit may have a flange portion for engaging a cartridge unit. In this embodiment, a cartridge unit having a cartridge housing and openings at each of its top and bottom ends is also provided. A sealing wall is disposed within the cartridge housing capable of forming a fluid-tight seal at or near the top opening of the cartridge housing, the sealing wall being movable between two positions. In its first position the sealing wall forms a fluid-tight seal with the cartridge housing, and in its second unsealed position, a flow-communication is established with the inside of the cartridge unit through the top opening of the cartridge housing. A displaceable member provided within the cartridge housing to move the sealing wall between the sealed position and the unsealed position. The displaceable member has a side wall that sealingly engages the inside wall of the cartridge housing in a fluid-tight manner, and has a manipulable portion at its bottom end for manipulating the displaceable member between the two positions. It is to be appreciated that the dispensing unit may be adapted and configured to sealingly engage a cartridge unit on either or both ends thereof, as will be further described herein below.

The present invention also provides processes for preparing multi-compartment assembly units for holding and storing multiple components of a formulation separately until the units are assembled into a single multi-compartment container and their contents mixed. The process includes:

(a) providing a dispensing unit having a housing and an opening at each of its top and bottom ends;

(b) sealing one end of the dispensing unit;

(c) introducing a first component of a formulation into the dispensing unit through the other end and sealing that end;

(d) providing one or more cartridge units having a cartridge housing and an opening at each of their top and bottom ends;

(f) placing a displaceable member within each of one or more cartridge units, the displaceable member having a sealing wall adapted to form a seal closing the top opening of the cartridge member, the displaceable member movable between a sealed position and an unsealed position; each displaceable member having a sealable filling opening at its bottom end in communication with inside chamber of the cartridge units; each displaceable member being placed in the cartridge member in the sealed position;

(g) introducing a different component of the formulation into each cartridge units through the sealable filling opening of the displaceable unit provided in each cartridge units; and (h) sealing the sealable filling openings.

Once the dispensing units and the cartridge units are prepared and sealed, they can be stored for extended periods of time until they are ready to be assembled into a single multi-compartment containers to mix the contents of each units into a formulation.

In another embodiment of the present invention, only one or more cartridge units, without any dispensing units, may be filled and then sealed to be stored and assembled into a multi-compartment container just prior to use.

After the user has assembled the filled assembly units into a multi-compartment container and mixed and dispensed the contents of the container, the assembly units can be reused. The assembly units may be disassembled and then refilled. The refilling process would be same as the processes described above.

The empty assembled multi-compartment container may also be filled and sealed in its assembled state. An example of a such refilling process where the assembled multi-compartment container comprises a dispensing unit and two cartridge units will now be described. With all the assembly units in flow-communication with each other, the interior of the multi-compartment container is first rinsed and cleaned using suitable cleaning agents. After the interior of the multi-compartment container is sufficiently dried, each of the assembly units forming the multi-compartment container may be refilled by first introducing a first component of a formulation into the bottom-most cartridge unit through the dispensing unit's top opening. The first component of the formulation will travel through each of the compartments corresponding to each of the assembly units until it reaches the bottom cartridge unit. The bottom cartridge unit is then sealed by moving its displaceable member into its sealed position. With the bottom-most cartridge unit filled and sealed, the remaining interior of the multi-compartment is rinsed, cleaned, and dried again so that any remnants of the first component of the formulation is removed.

Next, a second component of the formulation is introduced into the multi-compartment container assembly through the dispensing unit's top opening. The second component will travel down through the assembly until it reaches the second cartridge unit that is above the bottom-most cartridge unit. This second cartridge unit is then sealed by moving its displaceable member into its sealed position. With the second cartridge unit filled and sealed, the interior of the dispensing unit is rinsed, cleaned, and dried again to remove any remnants of the second component of the formulation.

Next, a third component of the formulation is introduced into the dispensing unit through the dispensing unit's top opening. The top opening may then be sealed with a suitable sealing member. The multi-compartment container is now ready to be used again or stored until ready for use.

It would be appreciated by one of ordinary skill in the art that the process of refilling a multi-compartment assembly that comprises two or more of cartridge units without any dispensing units would follow the same process steps as described above until the top-most assembly unit is reached. In this example, since the top-most assembly unit is a cartridge unit, it would be sealed by moving its displaceable member to its sealed position after a component of the formulation is introduced into its interior.

Furthermore, the assembly units, according to the present invention, may be pre-assembled into a multi-compartment container and then stored as an assembly until the contents of each units are ready to be mixed into a formulation. It is to be appreciated that in the assembled state, each dispensing unit and one or more cartridge units form separate compartments of the multi-compartment container preventing the contents of each units from mixing prematurely.

The invention will now be illustrated in some specific embodiments directed to a two and three-compartment container assemblies fitted with a baby feeding nipple as the dispensing device. It will be appreciated by one of ordinary skill in the art that the same principle is also applicable to form containers with additional separate components, and containers for other applications and areas where it is desired to store components of multiple-component formulations separately in individual containers and then assemble the individual assembly units into a single multi-compartment container which will store the components separately in such multi-compartment containers which may later be mixed to form and dispense the formulation.

The drawings are only schematic and are not necessarily to scale.

DETAILED DESCRIPTION OF A SPECIFIC EMBODIMENT

Some examples of the multi-compartment containers are provided to illustrate various specific configurations and examples of the invention. The invention should not be regarded as being limited to these embodiments. The containers may also be used for different uses, e.g., two or more compartment containers for medicinal formulations, dietary powders to be reconstituted with a liquid, alcoholic beverages to form cocktails with other ingredients or various non-alcoholic beverages that are prepared from powders wherein one compartment contains one component and the other compartment contains another component to be mixed to form a formulation.

Figure 1:
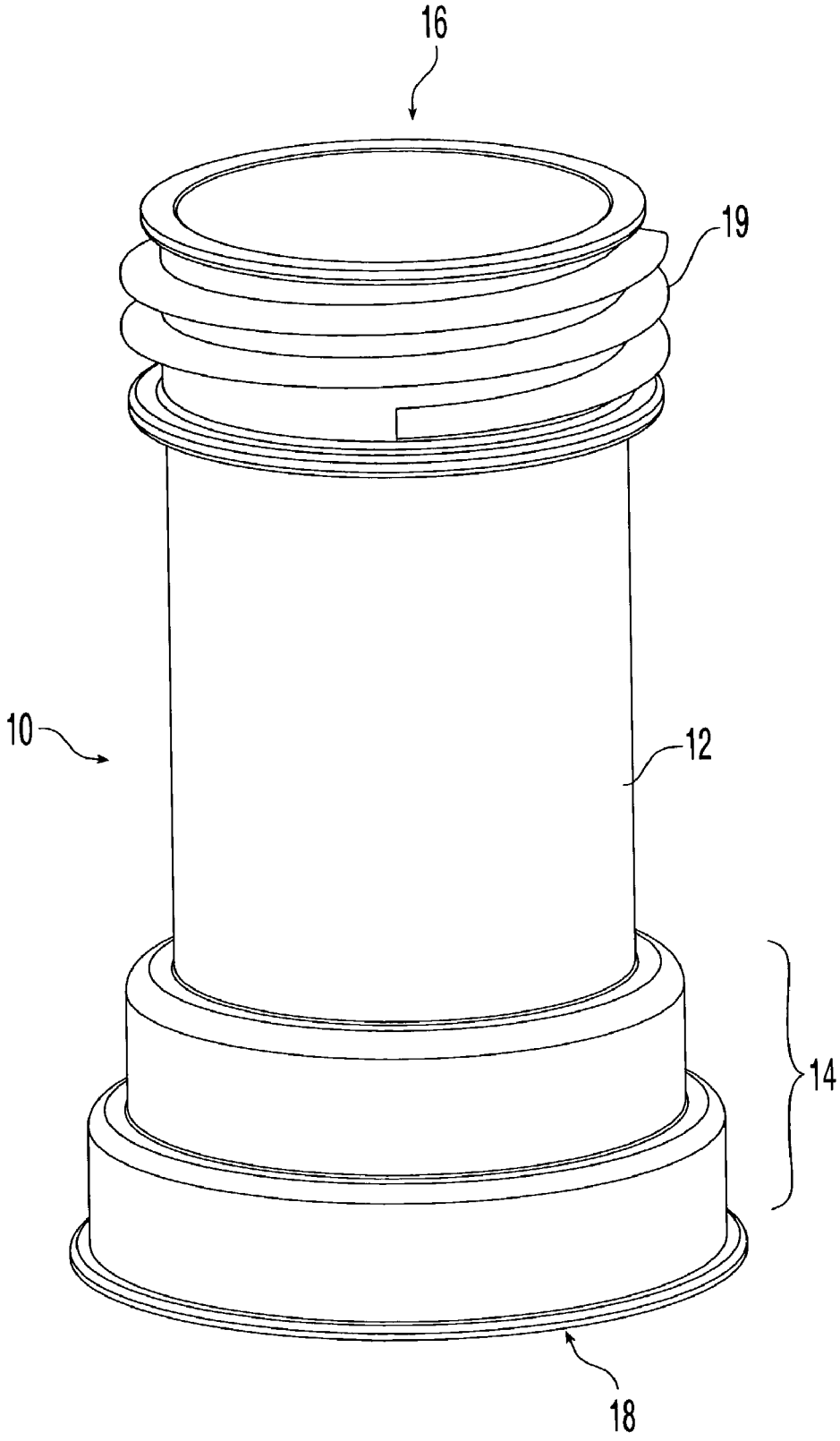
FIG. 1 is a perspective view of a dispensing unit with its top opening unsealed.

FIG. 1 illustrates a dispensing unit 10 with a body 12 and a top opening 16 and a bottom opening 18. Body 12 may be provided with a flange portion 14 at the bottom end of body 12 for receiving and engaging with a cartridge unit 30 shown in FIG. 2. Near the top opening of dispensing unit 10, a suitable mechanism for attaching an appropriate dispensing device or a cartridge unit may be provided. For illustrative purposes, in this embodiment dispensing unit 10 is provided with a screw thread 19 for threadably attaching a dispensing device or a cartridge unit.

Dispensing unit 10 may be filled with a component of a formulation which may typically be a liquid, a powdered substance, a gel, etc. During the storage of the dispensing unit 10, the top and bottom openings 16, 18 may be sealed to prevent contamination or spoilage of the contents of the dispensing unit. Openings 16 and 18 may be sealed with membranes 20 and 22 (see FIG. 3) respectively or with other suitable sealing methods (e.g., screw caps). The seals are preferably readily removable or peelable so that a multi-compartment container may be assembled to mix and dispense a formulation.

Figure 1A:
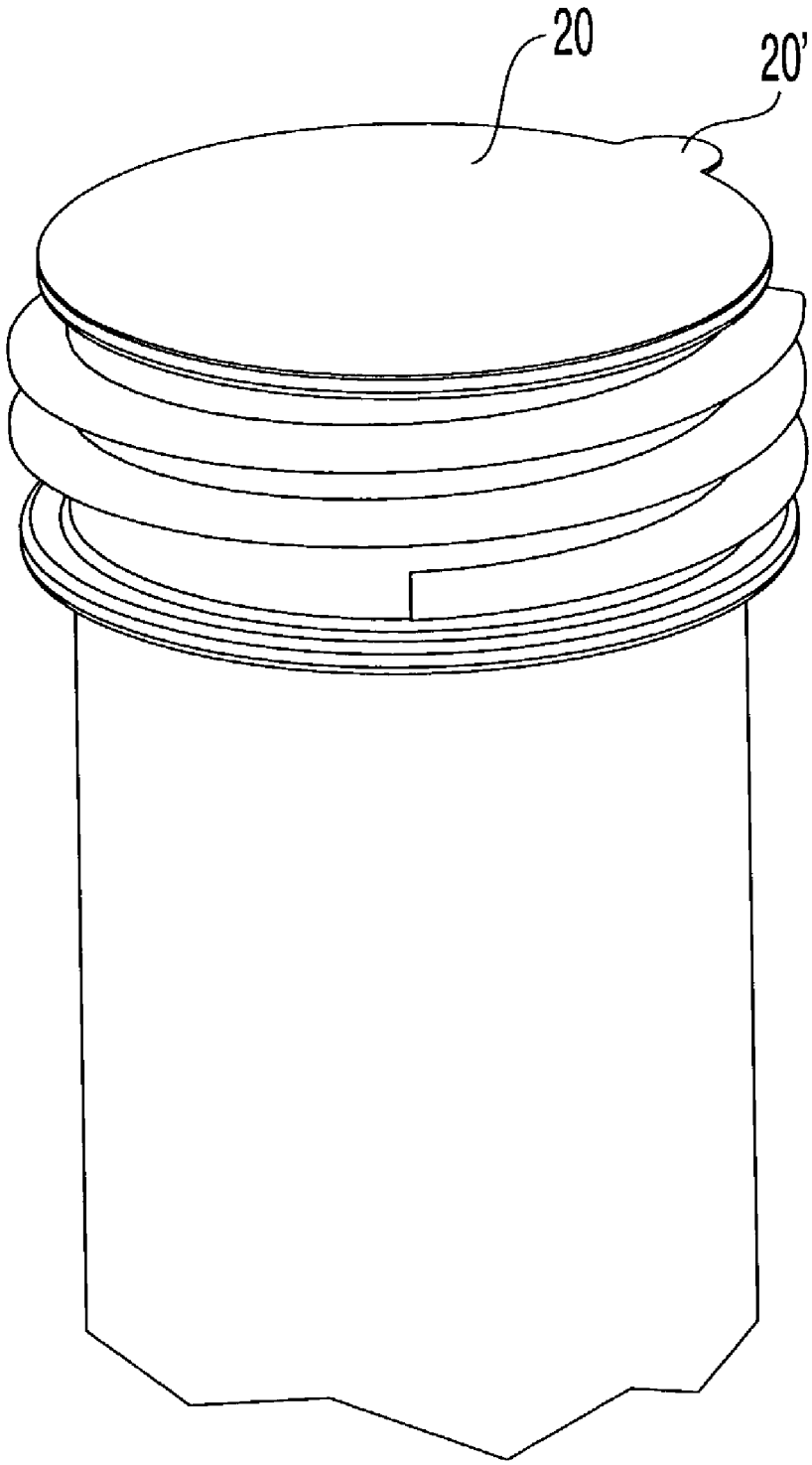
FIG. 1*a* is a partial perspective view of the dispensing unit of FIG. 1 with its top opening sealed with a membrane.

Sealing membranes 20 and 22 may be a foil or a non-metallic membrane, and may have a single or a multi-layered structure. The membranes are preferably heat sealed to the dispensing unit in such a manner that they may be peeled off. FIG. 1*a* illustrates an example of a membrane 20 sealing the top opening of dispensing unit 10.

Figure 2:
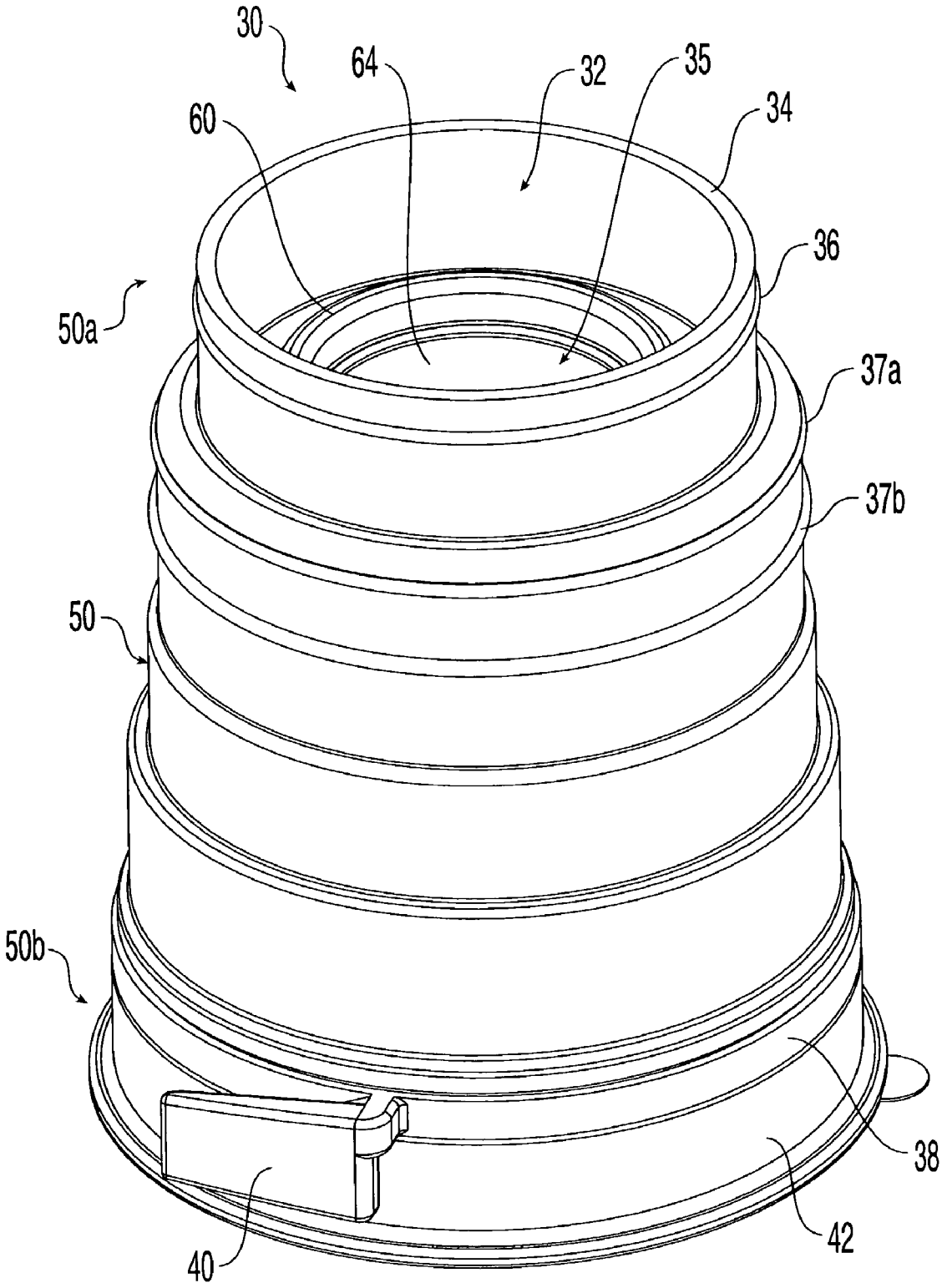
FIG. 2 is a perspective view of a sealed cartridge unit ready for assembly.

FIG. 2 illustrates a cartridge unit 30 which may be engaged with a dispensing unit 10 to form a two-compartment container. Cartridge unit 30 has a housing 50 with a top opening 32 formed by a joining sleeve 34. When cartridge unit 30 and dispensing unit 10 are assembled, joining sleeve 34 is inserted into flange portion 14 of dispensing unit 10. The outer surface of joining sleeve 34 maybe provided with one or more sealing ridges 36 that produces a friction-fitting joint with the inside wall of flange portion 14 to form a fluid-tight seal.

Near top opening 32 of cartridge unit 30 is a sealable opening 35 that can be sealed with a displaceable sealing wall 64. Displaceable sealing wall 64 can be displaced between a sealed position, sealing sealable opening 35 and an unsealed position, in which sealable opening 35 is open. Near the bottom end 50*b* of the cartridge housing, a security ring 42 is connected to the rest of the housing structure by a seal tamper prevention ribbon 38. Seal tamper prevention ribbon 38 is provided with a pull-tab 40 for removing the ribbon in order to detach security ring 42 from the rest of the cartridge housing. As described in more detail below, security ring 42 mechanically prevents accidental or unwanted displacement of sealing wall 64 from sealed position to an unsealed position. Other suitable mechanical means for preventing accidental displacement of the cartridge unit and preventing tampering therewith may be used, for example, external shrink sleeves (not shown).

Figure 3:
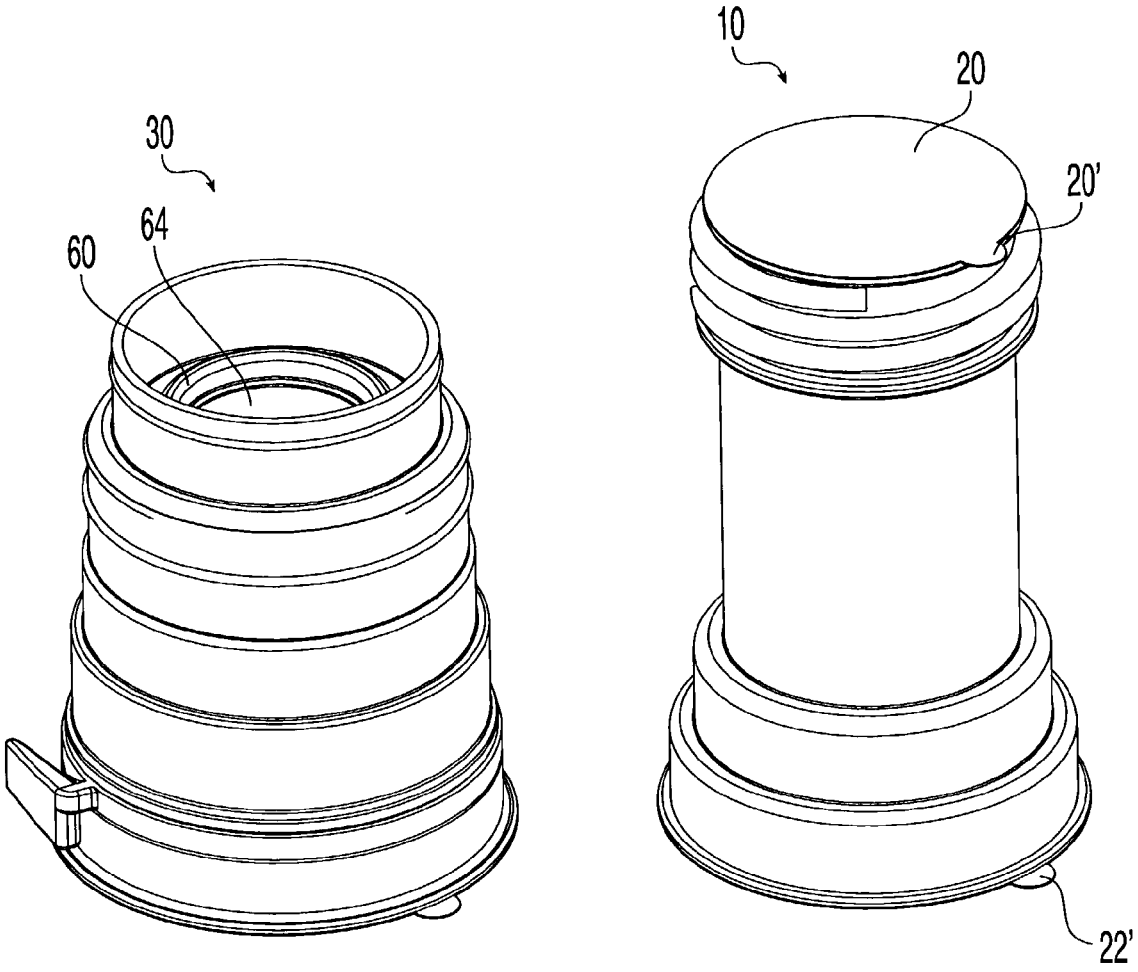
FIG. 3 is a perspective view of the dispensing unit of FIG. 1 and the cartridge unit of FIG. 2 in their sealed state.

FIG. 3 illustrates cartridge unit 30 and dispensing unit 10 in their sealed configuration, each holding a component of a formulation. Dispensing unit 10 of FIG. 1 is sealed on its bottom end with a sealing membrane 22.

Figure 4:
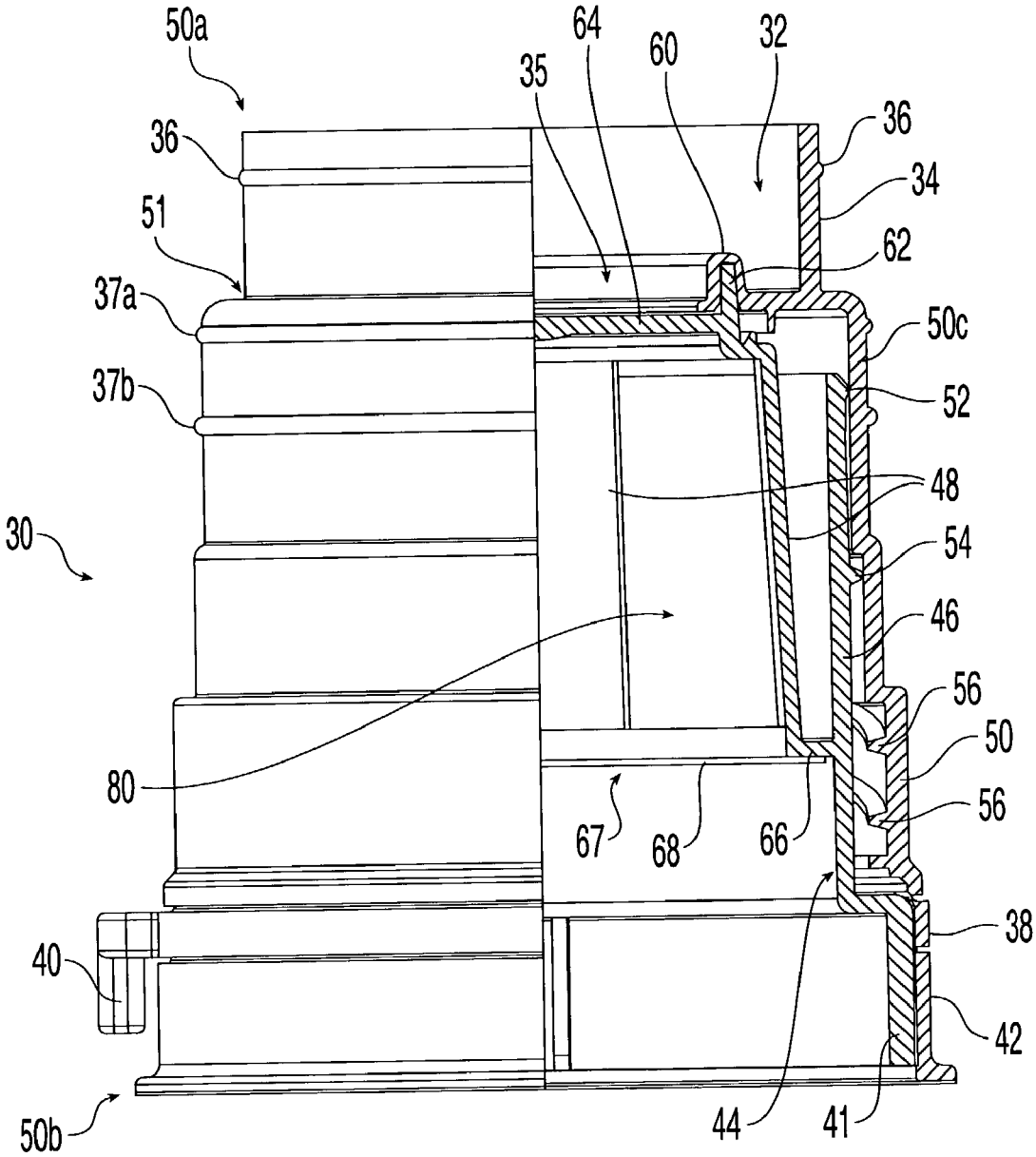
FIG. 4 is a partial cutaway view of a cartridge member with its displaceable member in a sealed position.

FIG. 4 illustrates a partial cutaway view of cartridge unit 30 according to one embodiment of the invention showing some detailed structures of the cartridge unit. Cartridge unit 30 has a generally cylindrical housing 50 having a top end 50*a* and a bottom end 50*b* and a neck portion 51. The housing has a joining sleeve 34 at the top end for engaging a dispensing unit, such as dispensing unit 10 illustrated in FIGS. 1 and 3, or another cartridge unit when used to piggy-back onto another cartridge unit to assemble a multi-compartment container. Provided on the outer surface of joining sleeve 34 are one or more sealing ridges 36 that will form a fluid-tight seal with the inside wall of flange 14 of dispensing unit 10 when the two units are assembled together to form a two-compartment container.

Although FIG. 4 illustrates an embodiment of the cartridge unit having a neck portion 51, it would be appreciated that a cartridge unit may not have a neck portion delineating joining sleeve 34 and the rest of the cartridge housing. The joining sleeve may have the same diameter as the rest of the cartridge housing without any neck portion.

Inwardly projecting from neck portion 51 is an annular engagement member 60 formed with a downwardly-facing groove 61 (see FIG. 5) which cooperates with an 35 annular projection 62, projecting from a sealing wall 64 of a displaceable member 44, to form a fluid-tight seal that closes opening 35. Annular projection 62 may be fabricated of elastomeric materials to enhance sealing. In FIG. 4, displaceable member 44 is in the sealed position.

Displaceable member 44 is provided within container housing 50 and has a user manipulable portion 41 for axially displacing the displaceable member between a sealed position, where sealing wall 64 engages annular engagement member 60 closing opening 35 in a fluid-tight manner, and an unsealed position, where sealing wall 64 is disengaged from annular engagement member 60 allowing a flow-communication between inside chamber 80 of the cartridge unit and the outside environment through opening 35. Displaceable member 44 is connected to sealing wall 64 via one or more connecting member 48.

In a typical intended use, a dispensing unit 10 would be engaged to top end of a cartridge unit 30 whereby the dispensing unit and the cartridge unit form the upper and lower compartments of a two-compartment container assembly respectively. The two-compartment container may be assembled without breaking the seal formed by sealing wall 64 and may be used to store the components in assembled fashion and later controllably remove the seal to mix the components to form the formulation. Thus, disengaging sealing wall 64 from annular engagement member 60 would allow a flow-communication between the upper and lower compartments.

Displaceable member 44 further has an annular rim 66 defining a sealable filling opening 67, at the bottom end of cartridge unit 30, that provides access to inside chamber 80 of the cartridge unit. Sealable filling opening 67 may be sealed with a closure member 68. In a typical use, after displaceable member 44 is positioned inside the cartridge housing in the sealed position sealing the opening 35, the cartridge unit's inside chamber 80 may be filled with a component of a formulation through sealable filling opening 67 on the bottom side of the displaceable member. Sealable filling opening 67 may then be sealed with closure member 68. Closure member 68 may be a membrane sealed to annular rim 66 by a suitable sealing method such as heat sealing or threaded or pressure fitted cap (not shown). As discussed above in reference to sealing membrane 20 of dispensing unit 10, closure member 68 also may be a foil or a non-metallic membrane having a single or multi-layered structure. Alternatively, the displaceable member may be configured so that the bottom sealable filling opening is sealed and displaceable member 44 is positioned inside the cartridge housing in the unsealed position so that the cartridge unit may be filled through unsealed opening 35 and then moving the displaceable member to seal opening 35.

Displaceable member 44 further has a side wall portion 46 which threadably engages cartridge housing 50 to enable manipulation of displaceable member 44 between a sealed position and an unsealed position by turning manipulable portion 41. A thread structure 56 is provided on the inside surface of housing 50 and the displaceable member's mating thread structure 58 (see FIG. 5) is provided on the outside surface of side wall portion 46. To move the displaceable member into its unsealed position, displaceable member 44 is rotated (typically in a counter-clockwise direction) using manipulable portion 41 so that the two thread structures 56 and 58 unscrew. This motion displaces the displaceable member 44 downwardly along the longitudinal axis of the cartridge unit so that the annular projection 62 disengages from annular engagement member 60 to establish a flow-communication between the cartridge unit's inside chamber 80 and the outside environment through opening 35.

Figure 5:
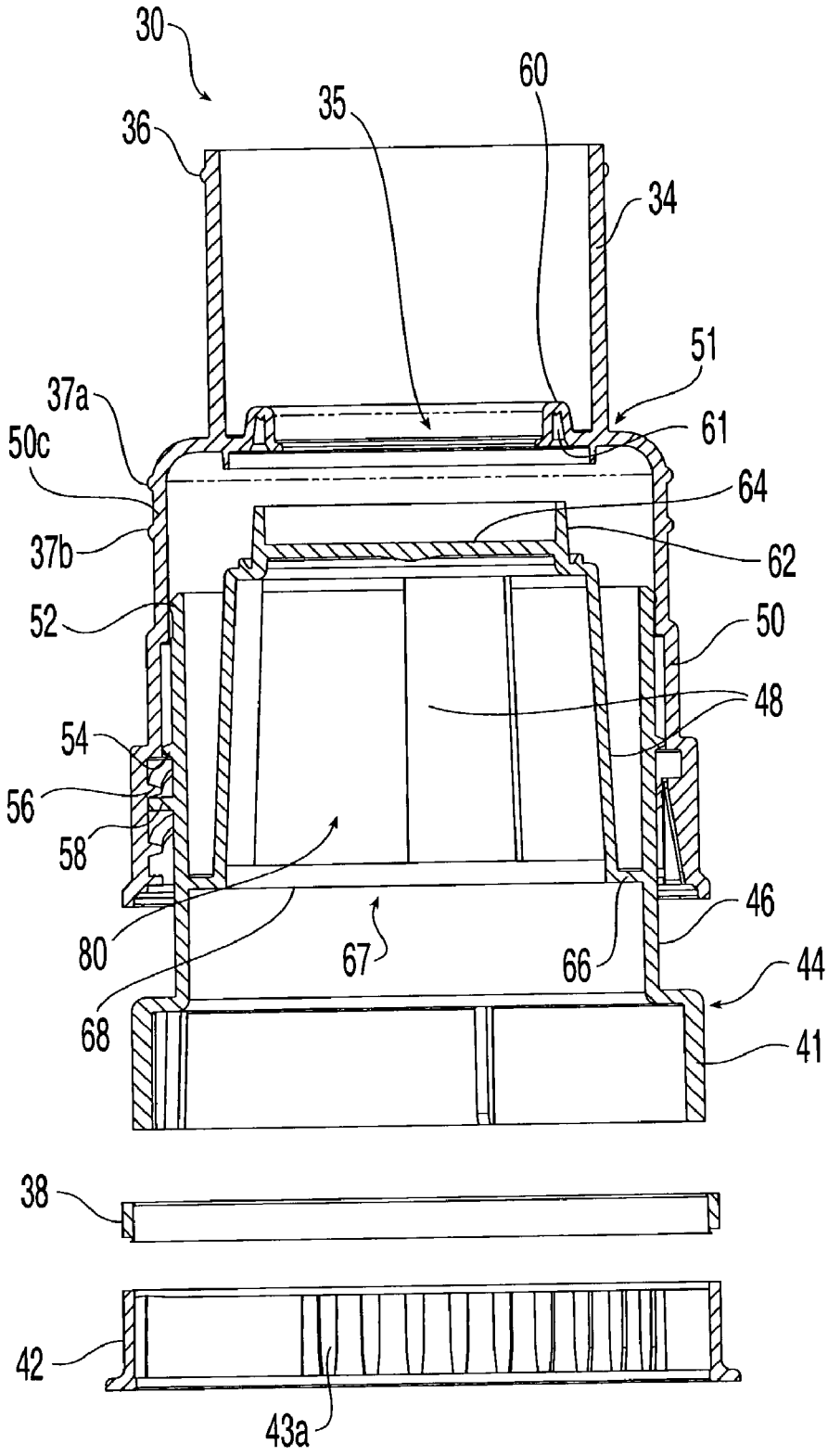
FIG. 5 is a longitudinal cross-sectional exploded view of a cartridge member with its displaceable member displaced into its unsealed position after the seal tamper prevention ribbon and the security ring has been removed.

As illustrated, displaceable member 44 preferably may be provided with additional sealing ridges 52 and 54 that sealably contact the inside surface of cartridge housing 50. These sealing ridges preferably form liquid-tight seals so that the mixed liquid formulation does not leak when displaceable member 44 is in the unsealed position as illustrated in FIG. 5. These seals, however, can be fabricated of elastomeric materials to enhance sealing and preferably are air-permeable so that, in a fully assembled multi-compartment container assembly, as the displaceable member is being unsealed the temporary vacuum condition created at the seal between annular engagement member 60 and annular projection 62 can draw in air from outside the container. The temporary vacuum condition may make it difficult for the end user to unseal the displaceable member (in extreme cases the vacuum may prevent the displaceable member from being lowered altogether) or can distort and warp the container. But, the air-permeable seal provided by sealing ridges 52 and 54 allow air to be introduced into the container during the unsealing step equalizing the air pressure between the inside and outside of the container. This allows displaceable member 44 to be displaced into its unsealed position without encountering opposing suction forces created by the temporary vacuum condition described above and alleviates distortion of the container. The sealing ridges 52 and 54 also stabilize the movement of displaceable member 44 during the unsealing step preventing the displaceable member from wobbling with respect to the longitudinal axis of the cartridge.

The bottom end 50*b* of the cartridge housing 50 and the manipulable portion 41 of displaceable member 44 may be adapted and configured to have a security mechanism whereby any undesirable displacement of the displaceable member is prevented. Such security measure will prevent unwanted unsealing of the fluid-tight seal between sealing wall 64 of the displaceable member and annular engagement member 60 of the cartridge housing. In the particular embodiment of the cartridge unit illustrated here, cartridge housing 50 has a security ring 42 that interlocks with manipulable portion 41 of displaceable member 44 preventing the displaceable member from rotating which in turn prevents any axial displacement of the displaceable member. The interlocking between manipulable portion 41 and security ring 42 may be achieved by providing a set of interlocking teeth structure 43*a* (see FIG. 5) on the inside surface of security ring 42 and a mating set of interlocking teeth structure 43*b* (see FIG. 8) on the outer surface of manipulable portion 41.

Cartridge housing 50 may be provided with a seal tamper prevention ribbon 38 that connects security ring 42 to the rest of the housing 50. Removing seal tamper prevention ribbon 38 by pulling on the pull-tab 40 (see FIG. 2), detaches security ring 42 from the housing 50 so that manipulable portion 41 is accessible to the user for axially displacing the displaceable member into an unsealed position.

FIG. 5 illustrates a longitudinal cross-sectional view of cartridge unit 30 where displaceable member 44 is in an unsealed position. As illustrated, seal tamper prevention ring 38 and security ring 42 have been removed. In this illustration, the interlocking teeth structure 43*a* on the inside surface of security ring 42 is shown. The displaceable member 44 has been axially displaced unsealing the fluid-tight seal between sealing wall 61 and annular engagement member 60.

Figure 6:
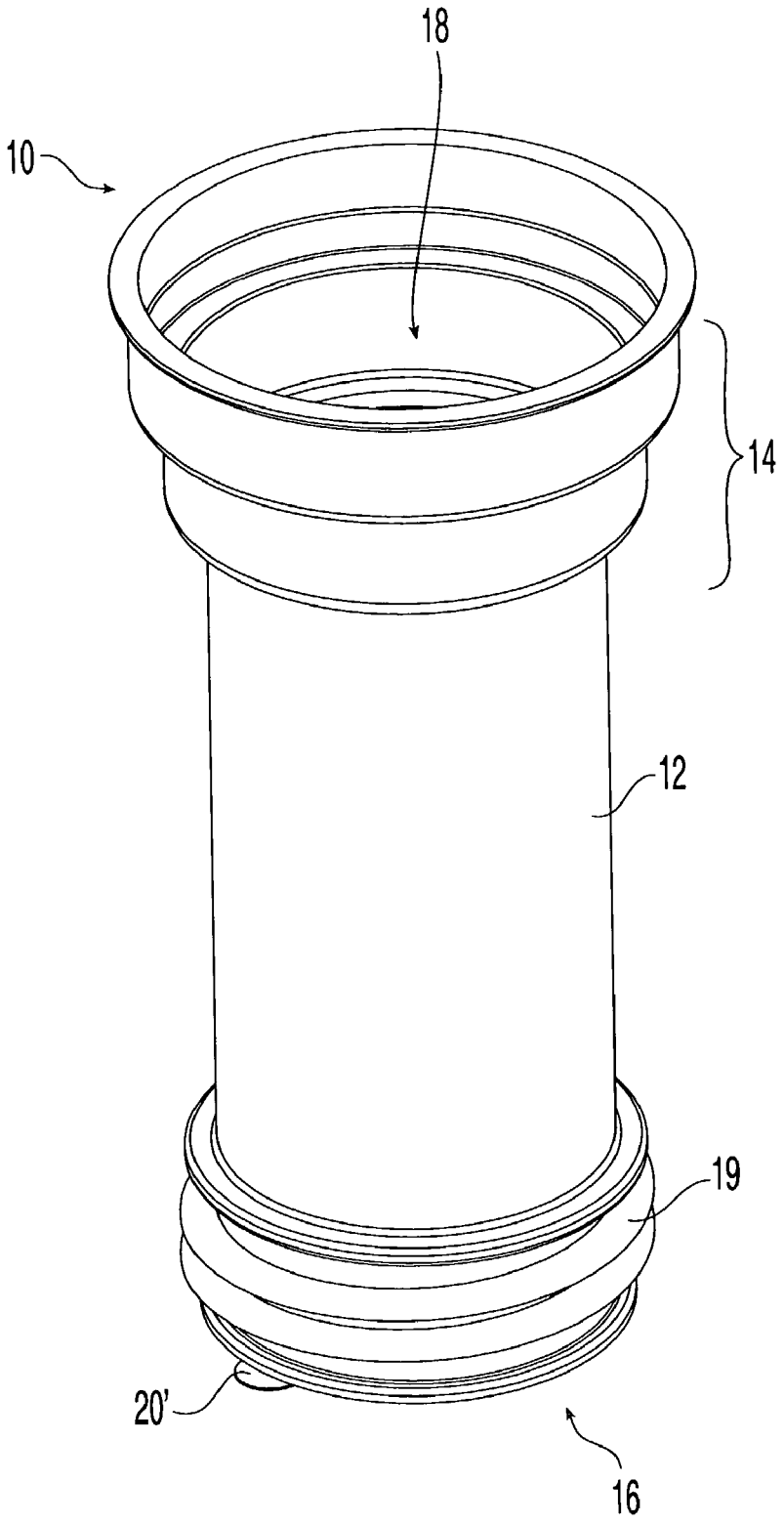
FIG. 6 is a perspective view of a dispensing unit with its bottom sealing membrane removed and ready for assembly.

FIG. 6 illustrates dispensing unit 10 of FIG. 3 where the dispensing unit is in a bottom-side up orientation and sealing membrane 22 has been removed from the bottom opening in preparation for receiving a cartridge member to assemble a two-compartment container. In order to assemble the multi-compartment container, this is the preferred assembly orientation for the dispensing unit because the sealing membrane 22 must be removed to insert the joining sleeve 34 of cartridge unit 30 into flange portion 14 during assembly. The bottom-side up orientation prevents the contents of the dispensing unit from spilling. As discussed in reference to FIG. 1, top-side opening 16 may be sealed with a membrane 20. As illustrated, sealing membranes 20 and 22 may be provided with tabs 20' and 22' respectively to enable the user to grab and pull the membranes.

Figure 7:
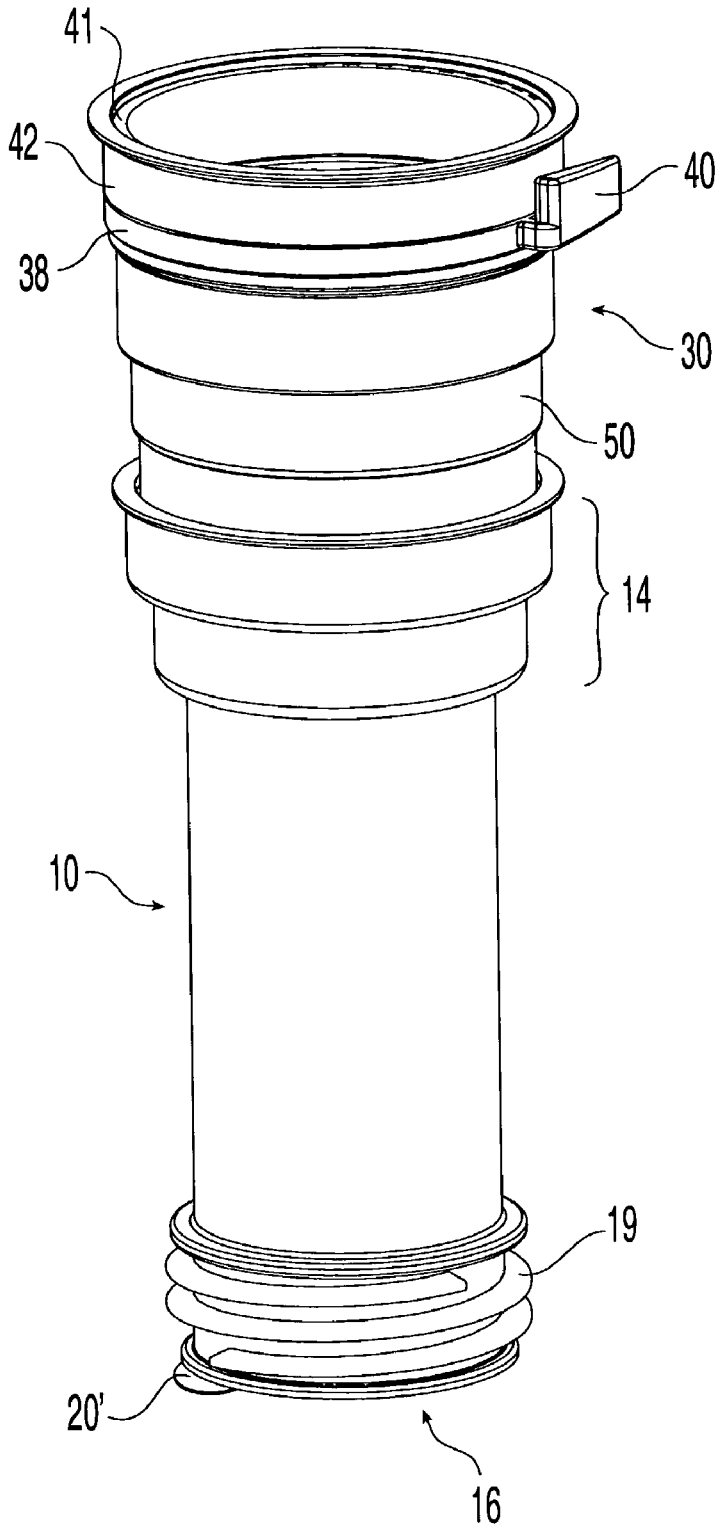
FIG. 7 is a perspective view of an as assembled two-compartment container illustrating the cartridge unit and the dispensing unit engaged with one another in a bottom-side up orientation before the seal tamper prevention ribbon and the security ring are removed.

FIG. 7 illustrates the assembled two-compartment container according to the present invention, in a bottom-side up orientation shortly after assembly, where a cartridge unit 30 has been inserted into flange portion 14 of dispensing unit 10 forming a two-compartment container. In this assembled state, the two assembly units, the dispensing unit and the cartridge unit form the upper and lower compartments of the assembled container respectively. And as illustrated, seal tamper prevention ribbon 38 and security ring 42 are in place thus ensuring that displaceable member 44 of the cartridge unit remains in the sealed position so that the contents of the two compartments are kept separate until ready to be mixed.

Figure 8:
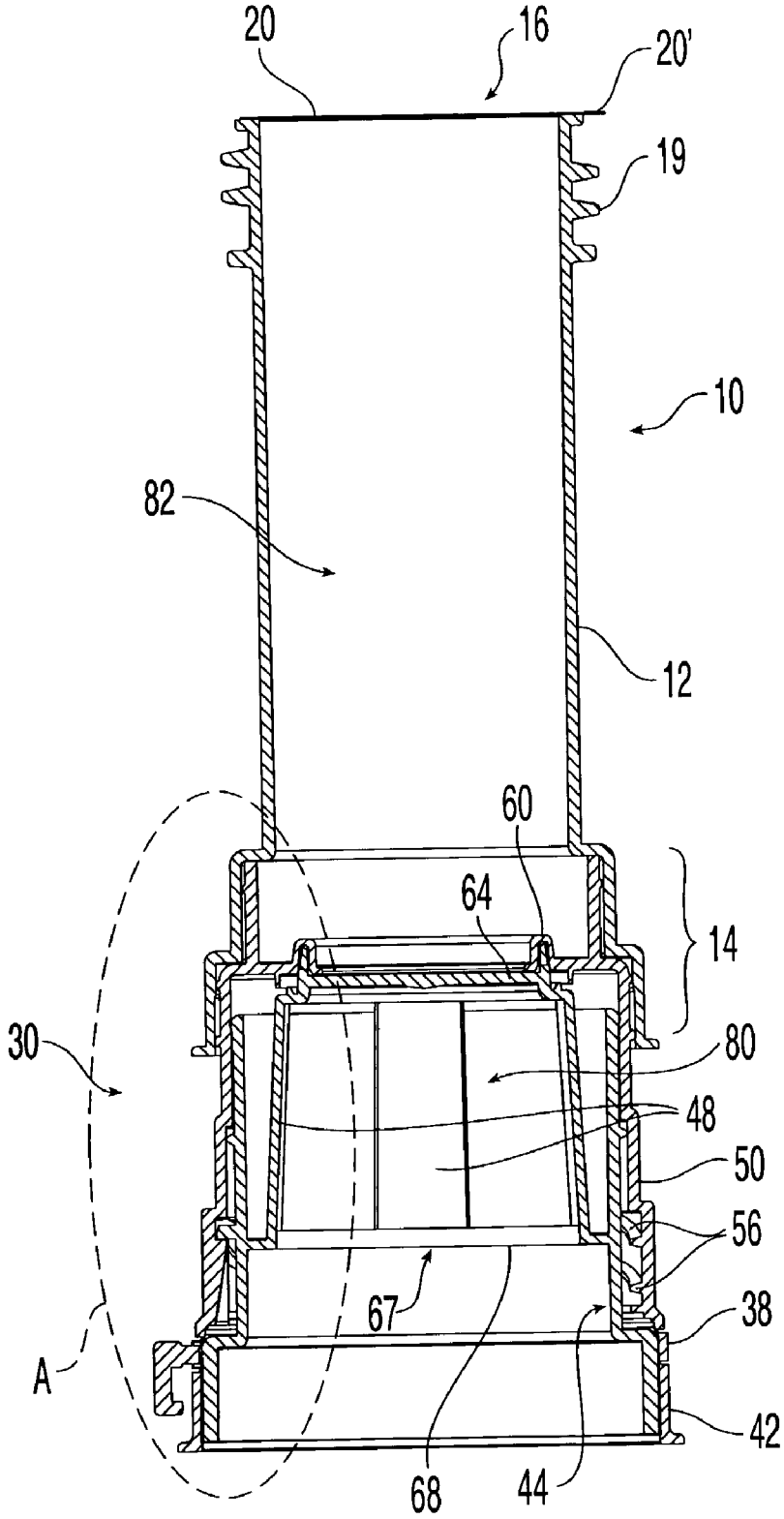
FIG. 8 is a longitudinal cross-sectional view of the assembled two-compartment container of FIG. 7.

FIG. 8 illustrates a longitudinal cross-sectional view of the assembled two-compartment container of FIG. 7. This as assembled two-compartment container has two sealed compartments 80 and 82. As illustrated, top opening 16 of dispensing unit 10 is sealed with a membrane 20 and sealable filling opening 67 of cartridge unit 30 is sealed with a closure member 68. And because displaceable member 44 of cartridge unit 30 is in the sealed position, the fluid-tight seal formed by sealing wall 64 and annular engagement member 60 separates inside chamber 80 of the cartridge unit from inside chamber 82 of dispensing unit 10. Thus, in the assembled state, the chambers 80 and 82 form the upper and lower compartments of the two-compartment container assembly.

Figure 9:
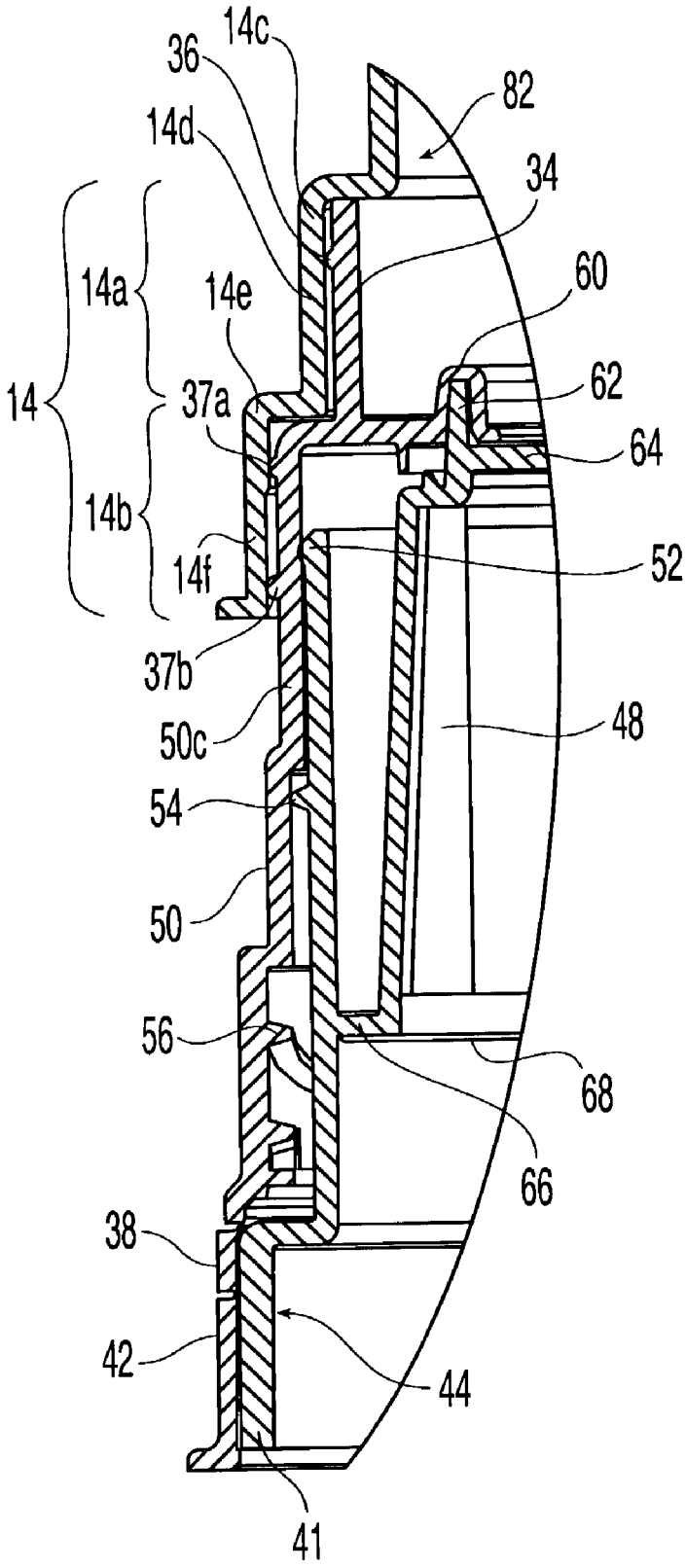
FIG. 9 is a detailed cross-sectional view of region A in FIG. 8.

FIG. 9 is a detailed cross-sectional view of the region A in FIG. 8. FIG. 9 illustrates that the fluid-tight seal between cartridge unit 30 and flange portion 14 of the dispensing unit is formed by one or more sealing ridges 36 provided on the outer surface of joining sleeve 34, and a pair of sealing ridges 37*a* and 37*b* that are provided on the outer surface of upper portion 50*c* of cartridge housing 50. The diameters of joining sleeve 34 and upper portion 50*c* of the cartridge unit and the corresponding mating surfaces of flange portion 14 are defined so that the two structures fit snugly when fully assembled. This allows sealing ridges 36, 37*a*, and 37*b* to form friction-fit seals with the inside surfaces of flange portion 14 that is fluid-tight and prevent the contents of the assembled container from leaking.

The detailed illustration of FIG. 9 shows that flange portion 14 is two-tiered having an upper portion 14*a* and a lower portion 14*b*. Upper portion 14*a* provides the sealing surface for sealing ridge 36 while lower portion 14*b* provides the sealing surface for sealing ridges 37*a* and 37*b*. Each portions 14*a* and 14*b* has a thick-walled section 14*c*, 14*e* and a thin-walled section 14*d*, 14*f* respectively. The flange portion 14 is configured this way to prevent the sealing ridges 36 and 37*a* from sealingly engaging the flange portion 14 prematurely as cartridge unit 30 is inserted into flange portion 14 during assembly.

As the cartridge unit is inserted into flange portion 14, sealing ridges 36 and 37*a* first pass through thin-walled sections 14*d* and 14*f* respectively. During this stage of the assembly, because the diameter of the openings provided by thin-walled sections 14*d* and 14*f* are sufficiently large, sealing ridges 36 and 37*a* do not make contact with sections 14*d* and 14*f*. This allows the air from inside chamber 82 of dispensing unit 10 to escape as the air is being compressed by cartridge unit 30 which is being inserted into flange portion 14. If air were not allowed to escape, the air pressure inside chamber 82 would prevent the cartridge unit from fully inserted into flange portion 14. As cartridge unit 30 is inserted further, sealing ridges 36 and 37*a* will sealably engage thick-walled sections 14*c* and 14*e*.

Flange portion 14 and the mating surfaces of cartridge unit 30 further may be provided with structures that lock the dispensing unit to the cartridge unit after they are assembled. An example of such locking structures may be a set of a groove and a mating projection that will lock the dispensing unit and the cartridge unit by a snap-fit connection.

Figure 10:
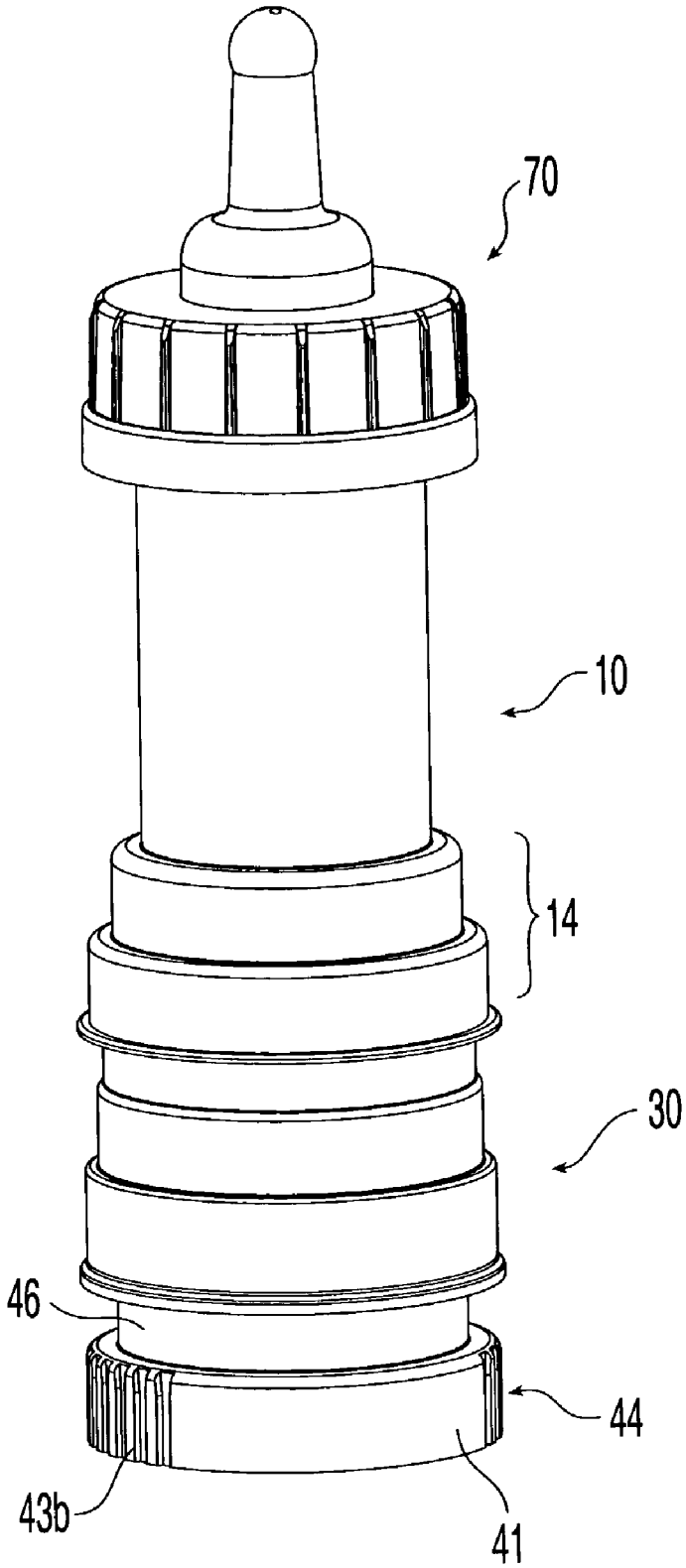
FIG. 10 is a perspective view of the assembled two-compartment container of FIG. 7, in a baby formula bottle embodiment, fitted with a baby feeding nipple assembly and the displaceable member of the cartridge unit in an unsealed position.

FIG. 10 illustrates the assembled two-compartment container of FIG. 7 in a top-side up orientation where the contents of the two compartments have been mixed into a formulation and a baby feeding nipple assembly 70 has been attached to the top opening of the container. Before attaching feeding nipple assembly 70, sealing membrane 20 would have been removed from top opening 16. FIG. 10 also shows that sealing tamper prevention ribbon 38 and security ring 42 have been removed in order to access the manipulable portion 41 of displaceable member 44. The displaceable member 44 has been axially displaced downward to the unsealed position so that the contents of the two compartments can be mixed.

Figure 11:
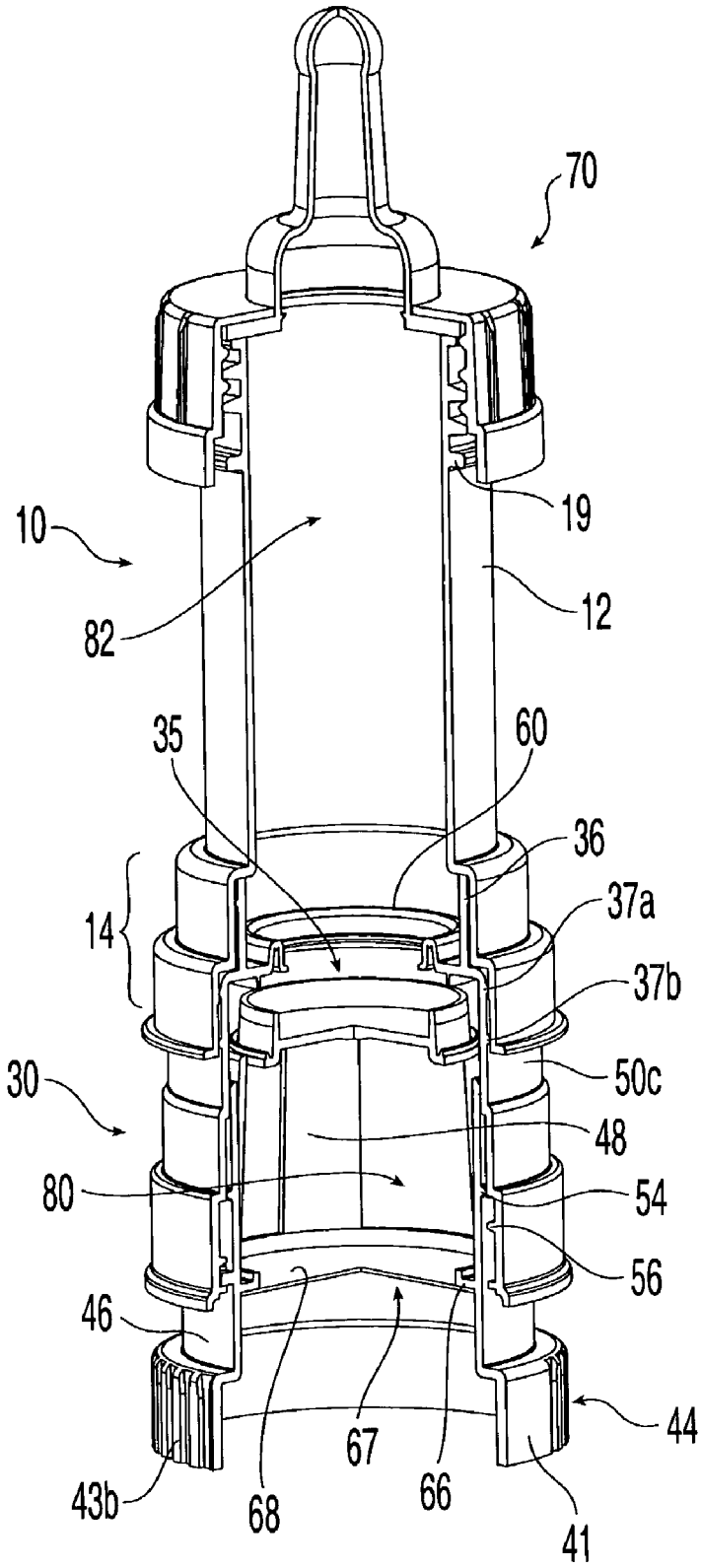
FIG. 11 is a longitudinal cutaway view of the assembled two-compartment baby formula bottle of FIG. 10.

FIG. 11 illustrates a longitudinal cutaway view of the assembled two-compartment container of FIG. 10. Feeding nipple assembly 70 may be threadably attached to the top opening by engaging the threads 19 as illustrated. Displaceable member 44 is in an unsealed position so that sealing wall 64 and its annular projection 62 are disengaged from annular engagement member 60 allowing flow-communication between the upper chamber 82 and lower compartment 80 through opening 35 at the neck portion 51 of the two-compartment container. The lower compartment 80 is sealed on the bottom side by closure member 68 that is sealed to the annular rim 66 of displaceable member 44.

Figure 12:
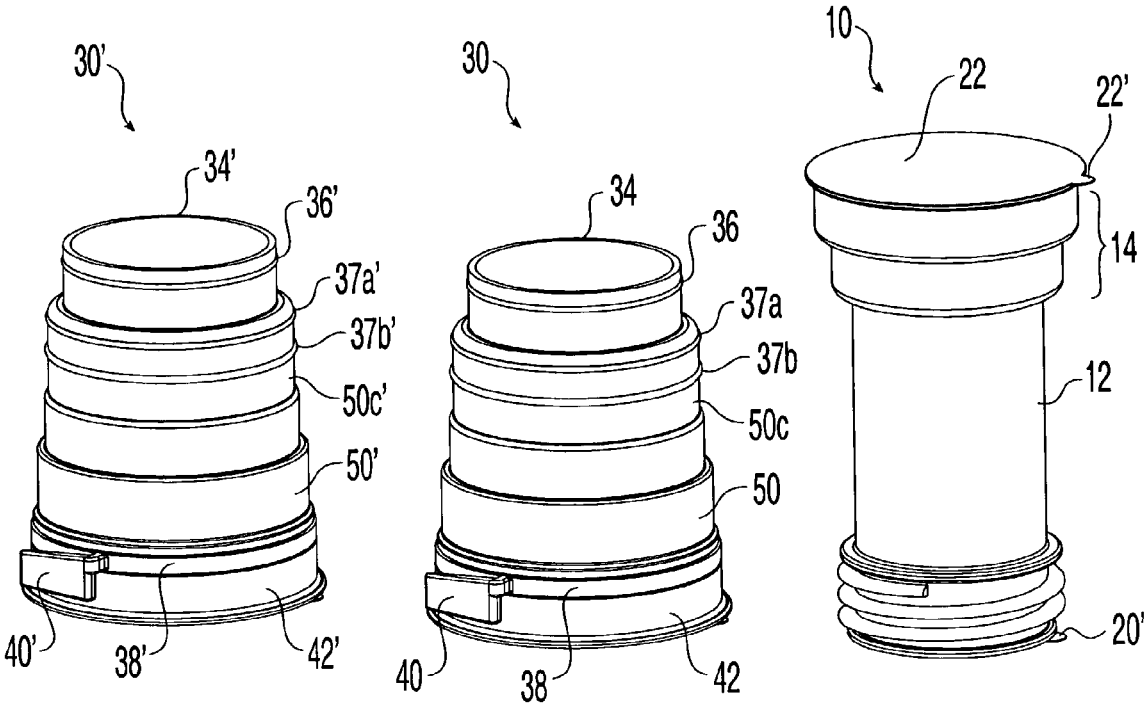
FIG. 12 is a perspective view of a sealed dispensing unit and two sealed cartridge units.

FIG. 12 illustrates a perspective view of the basic assembly units for assembling an embodiment of a multi-compartment container having more than two compartments. In this example, a dispensing unit 10 and two cartridge units 30 and 30' are utilized. Dispensing unit 10 has been placed in bottom-side up orientation showing that the bottom opening is sealed with sealing membrane 22. The cartridge units are configured so that the joining sleeve and the upper portion of one cartridge unit may fit into the bottom side opening (i.e., the sealable filling opening) of another cartridge unit's displaceable member. When two cartridge units are connected to one another serially in this manner, the two units engage to form fluid-tight seals in the same manner as the fluid-tight seal formed between a cartridge unit and a dispensing unit as described above in reference to FIG. 9.

Figure 13:
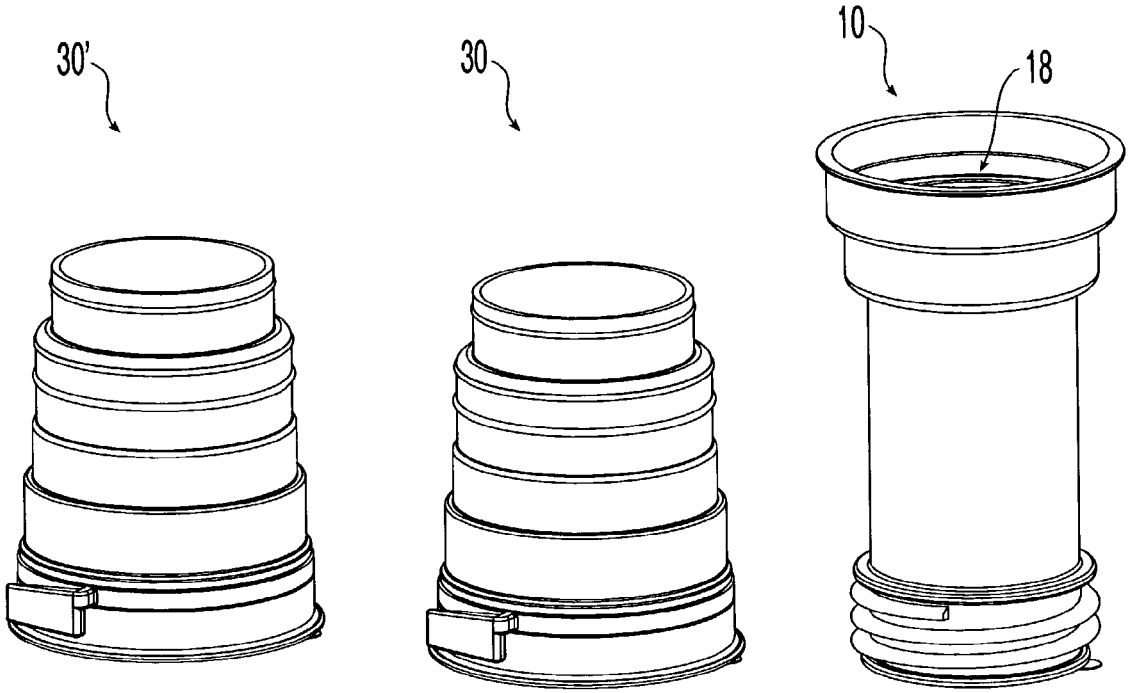
FIG. 13 is a perspective view of the assembly units of FIG. 12 with the bottom opening of the dispensing unit unsealed and ready for assembly.

FIG. 13 illustrates a perspective view of the assembly units of FIG. 12 where sealing membrane 22 has been removed from dispensing unit 10 exposing bottom opening 18 in preparation for assembling cartridge unit 30 and dispensing unit 10.

Figure 14:
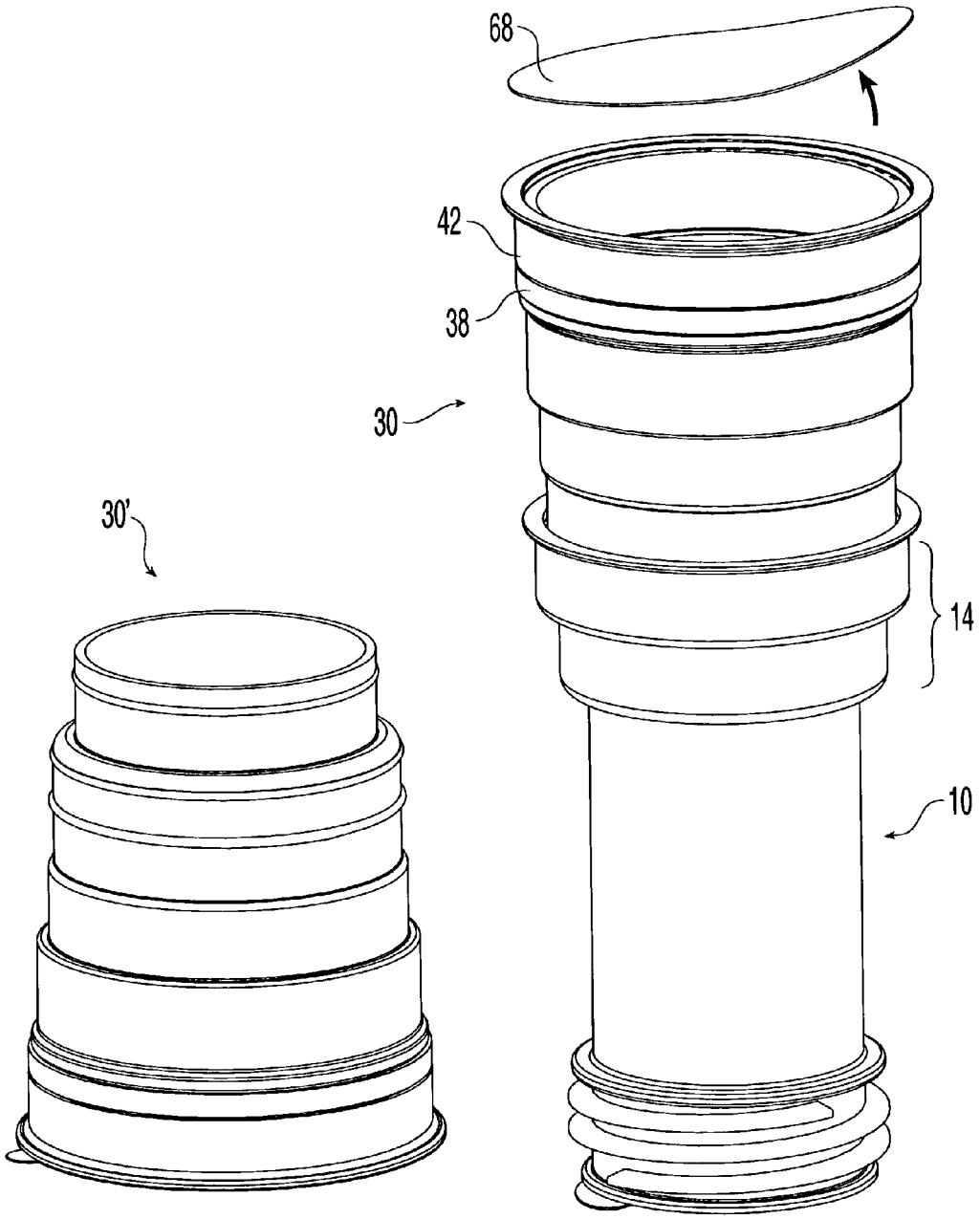
FIG. 14 is a perspective view of the assembly units of FIG. 13 with the first cartridge unit and the dispensing unit assembled into a two-compartment container.

FIG. 14 illustrates an interim stage in the assembly of a three-compartment container where cartridge unit 30 has been assembled with dispensing unit 10 by inserting the top open end of cartridge unit 30 into flange portion 14 of dispensing unit 10. Before the next assembly step of inserting a secondary cartridge unit 30' into the bottom of cartridge unit 30, closure member 68 must be removed from annular rim 66 of displaceable member 44 to unseal sealable filling opening 67. This temporarily exposes inside chamber 80 of cartridge unit 30 until second cartridge unit 30' is inserted into the bottom end of displaceable member 44. This allows the inside chambers of the two cartridge units to be in flow-communication with each other when displaceable member 44' of secondary cartridge unit 30' is in an unsealed position. (See FIG. 17 and accompanying text below).

Figure 15:
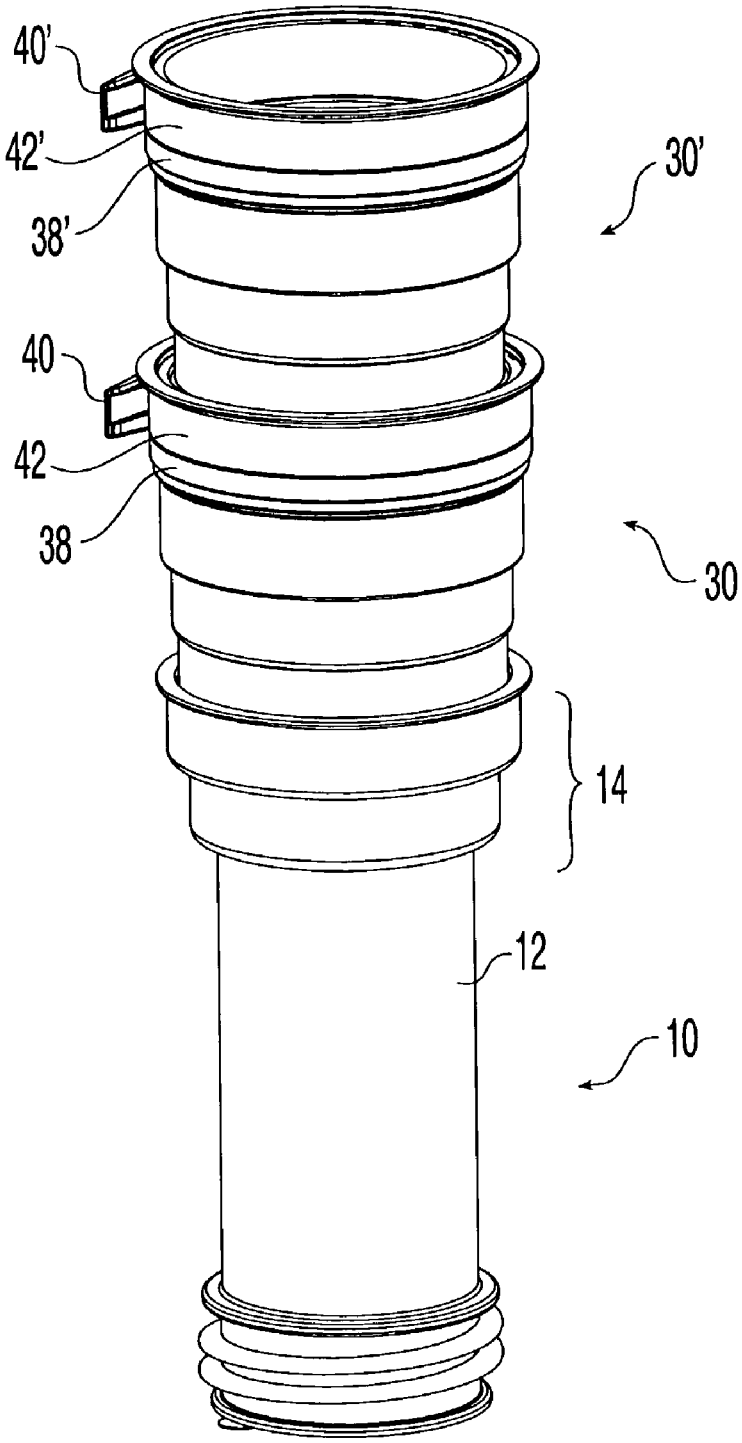
FIG. 15 is a perspective view of the assembly units of FIG. 14 with the second cartridge unit piggy-backed to the first cartridge unit forming a three-compartment container in a bottom-side up orientation.

FIG. 15 illustrates a fully assembled three-compartment container where two cartridge units are sealingly engaged to dispensing unit 10 in a serial manner. Cartridge unit 30' has been inserted into the bottom of displaceable member 44 of cartridge unit 30. The seal tamper prevention ribbons 38, 38' and security rings 42, 42' have not been removed from the cartridge units and therefore the three compartments formed by the two cartridge units 30 and 30' and dispensing unit 10 are scaled from one another to keep their contents separate until ready to be mixed.

Figure 16:
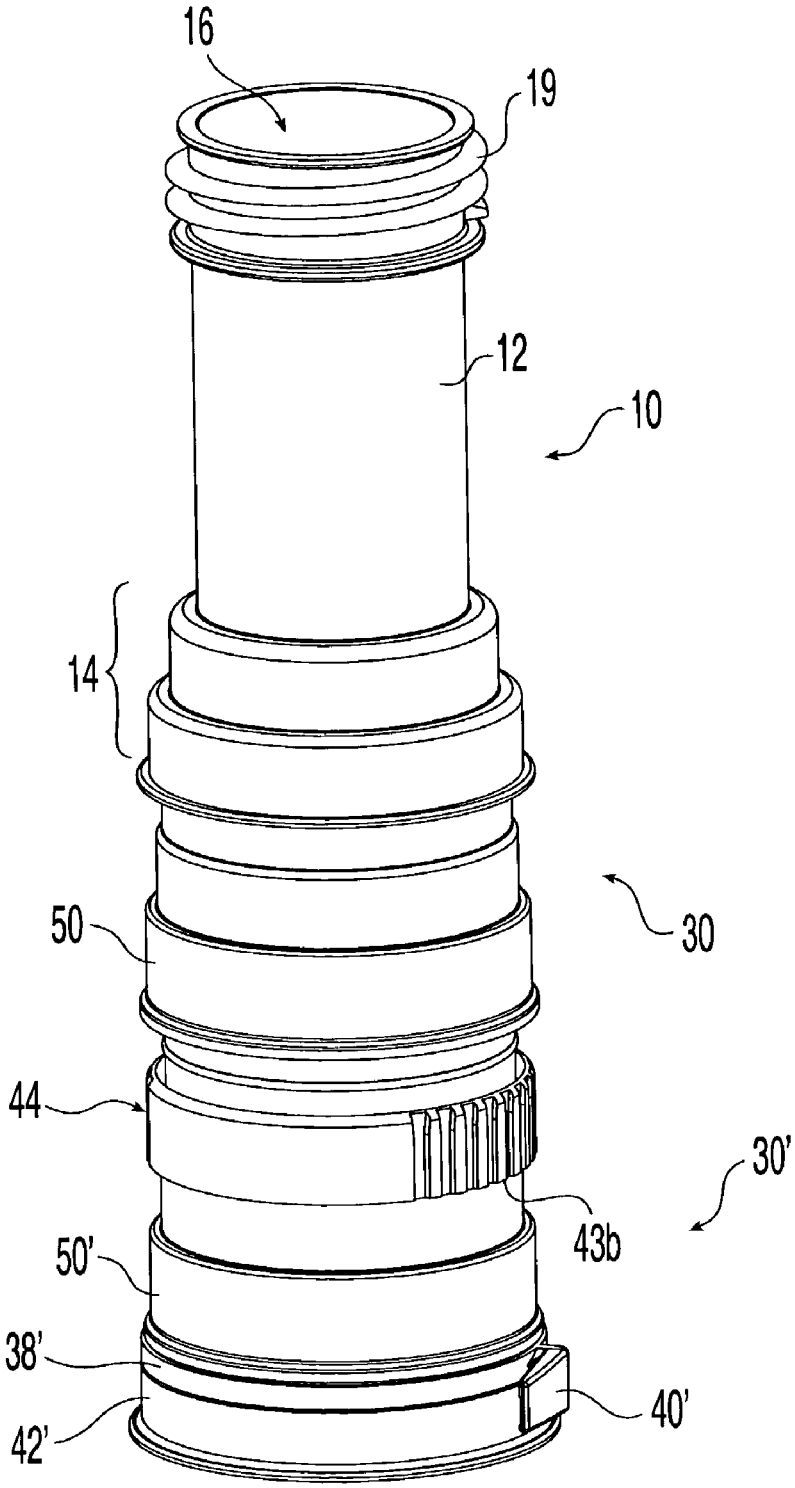
FIG. 16 is a perspective view of the three-compartment container assembly of FIG. 15 in a bottom-side down orientation where the top opening of the dispensing unit is unsealed in preparation for attaching a cartridge unit or a dispensing device.

FIG. 16 illustrates a perspective view of the three-compartment container assembly of FIG. 15 where displaceable member 44 of cartridge unit 30 has been axially displaced into the unsealed position establishing a flow-communication between the inside chamber of dispensing unit 10 and the inside chamber of cartridge unit 30 (the upper and middle compartments respectively). As illustrated, seal tamper prevention ribbon 38 and security ring 42 of cartridge 30 has been removed so that displaceable member 44 may be manipulated by turning the now exposed manipulable member 41. On the outer surface of manipulable portion 41, locking teeth structure 43*b* may now be seen since security ring 42 has been removed. In this illustration, sealing membrane 20 has been removed from dispensing unit 10 exposing top opening 16 for attaching an appropriate dispensing device.

Figure 17:
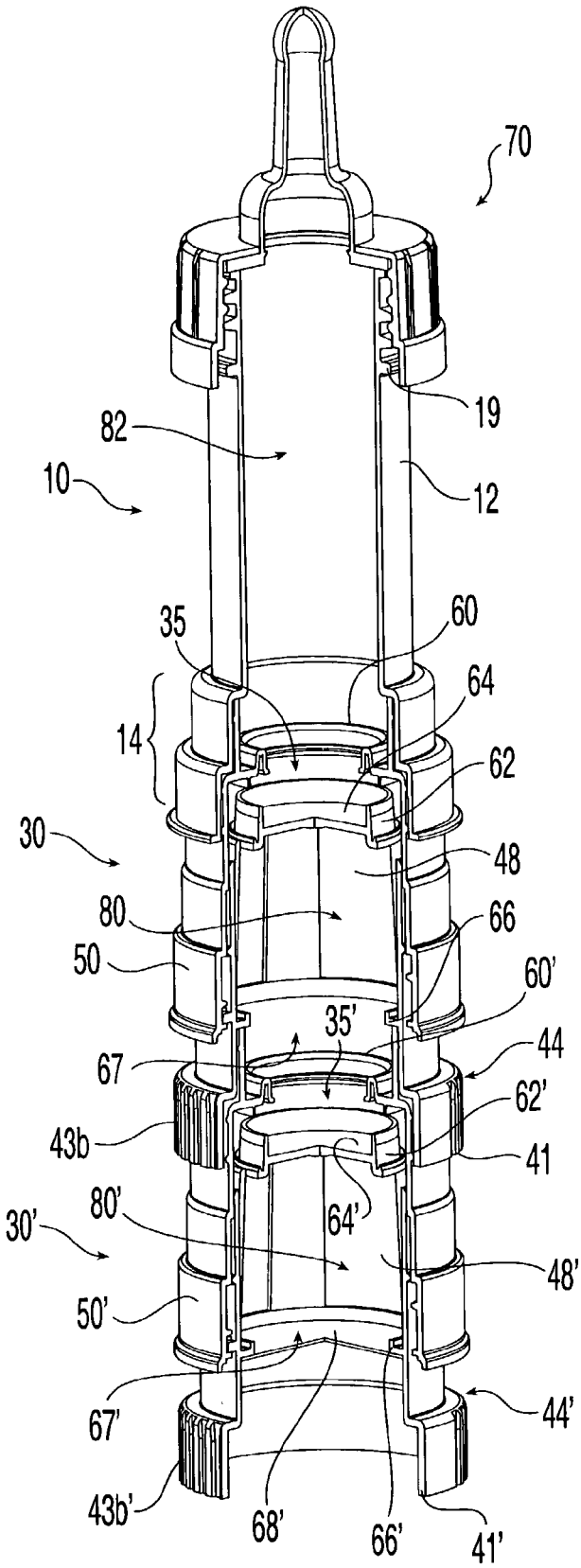
FIG. 17 is a partial cutaway drawing of the three-compartment container assembly of FIG. 16 fitted with a baby feeding nipple assembly at the top opening of the dispensing unit where the displaceable members of the two cartridge units have been moved to unsealed position for mixing the contents of the cartridges.

FIG. 17 illustrates a longitudinal cutaway view of the three-compartment container assembly of FIG. 16 where the displaceable members of both cartridge units have been axially displaced to their respective unsealed positions establishing flow-communication among all three compartments 82, 80, and 80' to allow the contents of the compartments to mix and form a formulation. As illustrated, displaceable member 44 of first cartridge unit 30 has been axially displaced into its unsealed position by turning the displaceable member via the manipulable portion 41. As discussed in reference to FIG. 4, displaceable member's side wall 46 threadably engages the inside surface of cartridge housing 50 and by turning the displaceable member, the user may manipulate it in an axial direction from a sealed position to an unsealed position. Thus, sealing wall 64 and its annular projection 62 have been disengaged from annular engagement member 60 thus allowing a flow-communication between upper chamber 82 and middle chamber 80 through opening 35.

In this illustration, displaceable member 44' of second cartridge unit 30' also has been axially displaced into its unsealed position. This may be achieved in a similar manner as described above in reference to displaceable member 44 of first cartridge unit 30. Sealing wall 64' and its annular projection 62' have been disengaged from annular engagement member 60' thus allowing a flow-communication between middle chamber 80 and lower chamber 80' through openings 35 and 67. It should be noted that, as discussed in reference to FIG. 14, closure member 68 has been removed from annular rim 66 of displaceable member 44 before secondary cartridge unit 30' was inserted into the bottom end of displaceable member 44 thereby unsealing opening 67. In contrast, closure member 68' of second cartridge unit 30' remains in place functioning as the bottom wall of the assembled three-compartment container.

It would be readily appreciated by one of ordinary skill in the art that additional cartridge units may be attached to second cartridge unit 30' in order to introduce additional compartment holding another component of a formulation. Before another cartridge unit can be attached to second cartridge unit 30', closure member 68' must be removed thereby unsealing sealable filling opening 67'.

It would be also appreciated that the cartridge units and the dispensing units of the assembly system of the present invention may be adapted and configured so that the assembly units can be screwed to one another. The appropriate openings of each assembly units can be provided with screw threads so that they can be assembled together like a bottle and a screw cap.

Returning to illustration of FIG. 17, with the three compartments of the container assembly, 82, 80, and 80', in flow-communication with one another, the contents of each compartment may be mixed to form a formulation. For illustrative purposes, a dispensing device in the form of a feeding nipple assembly 70 also has been threadably attached to top opening 16 of dispensing unit 10 by engaging threads 19.

In another embodiment, the displaceable member and its associated sealing wall of a cartridge unit are configured in such a manner that the sealing wall may be moved between a sealed position and an unsealed position without involving any axial movement of the displaceable member or the sealing wall.

Figure 18:
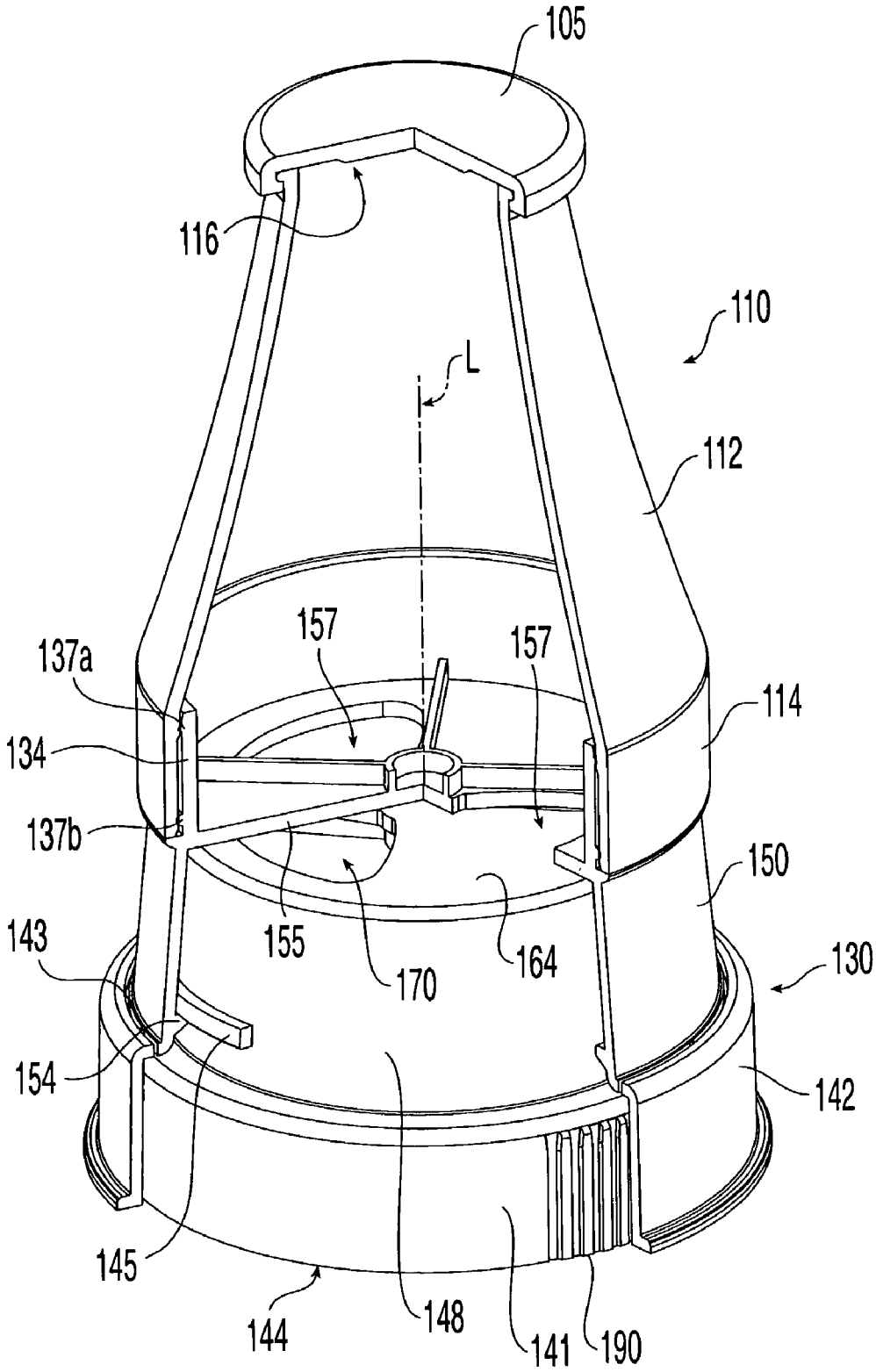
FIG. 18 is a perspective view of another embodiment of a multi-compartment container assembly system assembled as a two-compartment container.

FIG. 18 is an illustration showing a partial cutaway view of a such container assembly that has been assembled into a two-compartment configuration. This embodiment has a dispensing unit 110 assembled together with a cartridge unit 130. Dispensing unit 110 has a housing 112 and a flange portion 114 and a top opening 116 that may be fitted with a cap 105, or sealed with other appropriate sealing methods. Top opening 116 also may be fitted with an appropriate dispensing device to assist in dispensing of the contents of the container. Cartridge unit 130 has a housing 150 with a top-end wall 155 provided with one or more flow-through openings 157. Cartridge unit 130 further may be provided with a joining sleeve 134 in the form of an annular projection projecting above top-end wall 155. Joining sleeve may be provided with sealing ridges 137*a* and 137*b* that sealingly engage inside wall portion of flange portion 114 to form one or more fluid-tight seals between joining sleeve 134 and flange portion 114. Cartridge unit 130 also may be provided with a security ring 142.

A displaceable member 144 is provided within cartridge housing 150 and has a user manipulable portion 141 for rotationally moving the displaceable member between a sealed position and an unsealed position. User manipulable portion 141 of the displaceable member is connected to a sealing wall 164 via a side wall 148. Side wall 148 is provided with a retaining guide 145 on its outer surface that cooperates with projection 154 along the inside surface of cartridge housing 150 to retain the displaceable member in place as the displaceable member is rotated about longitudinal axis L of the cartridge unit between the sealed position and the unsealed position.

Sealing wall 164 of cartridge unit 130 is situated just below top-end wall 155 of the cartridge unit and has one or more flow-through openings 170 corresponding to the flow-through opening 157 of the top-end wall 155. When sealing wall 164 is in its sealed position, flow-through openings 170 and 157 are mis-aligned and the combination of sealing wall 164 and top-end wall 155 form a partitioning seal between dispensing unit 110 and cartridge unit 130. When sealing wall 164 is in its unsealed position, flow-through openings 170 and 157 are aligned with each other and the openings establish a flow-commnunication between dispensing unit 110 and cartridge unit 130.

Security ring 142 provided at the bottom end of cartridge unit 130 may be provided with a set of locking teeth structure on its inside surface (not shown in the drawing) that cooperate with a set of locking teeth 190 provided on the user manipulable portion 141 of displaceable member 144 to prevent the displaceable member from turning unnecessarily. This locking mechanism provides the security protection that prevents unsealing of the cartridge unit during storage and also prevents any premature unintended unsealing of the partitioning seal between dispensing unit 110 and cartridge unit 130. Security ring 142 is connected to cartridge housing 150 by a breakable joint 143 which may be broken by forcibly turning the security ring. Once breakable joint 143 is broken, the user may rotate the displaceable member into the unsealed position by turning the user manipulable portion 141 and mix the contents of the container into a formulation for use.

Figure 19:
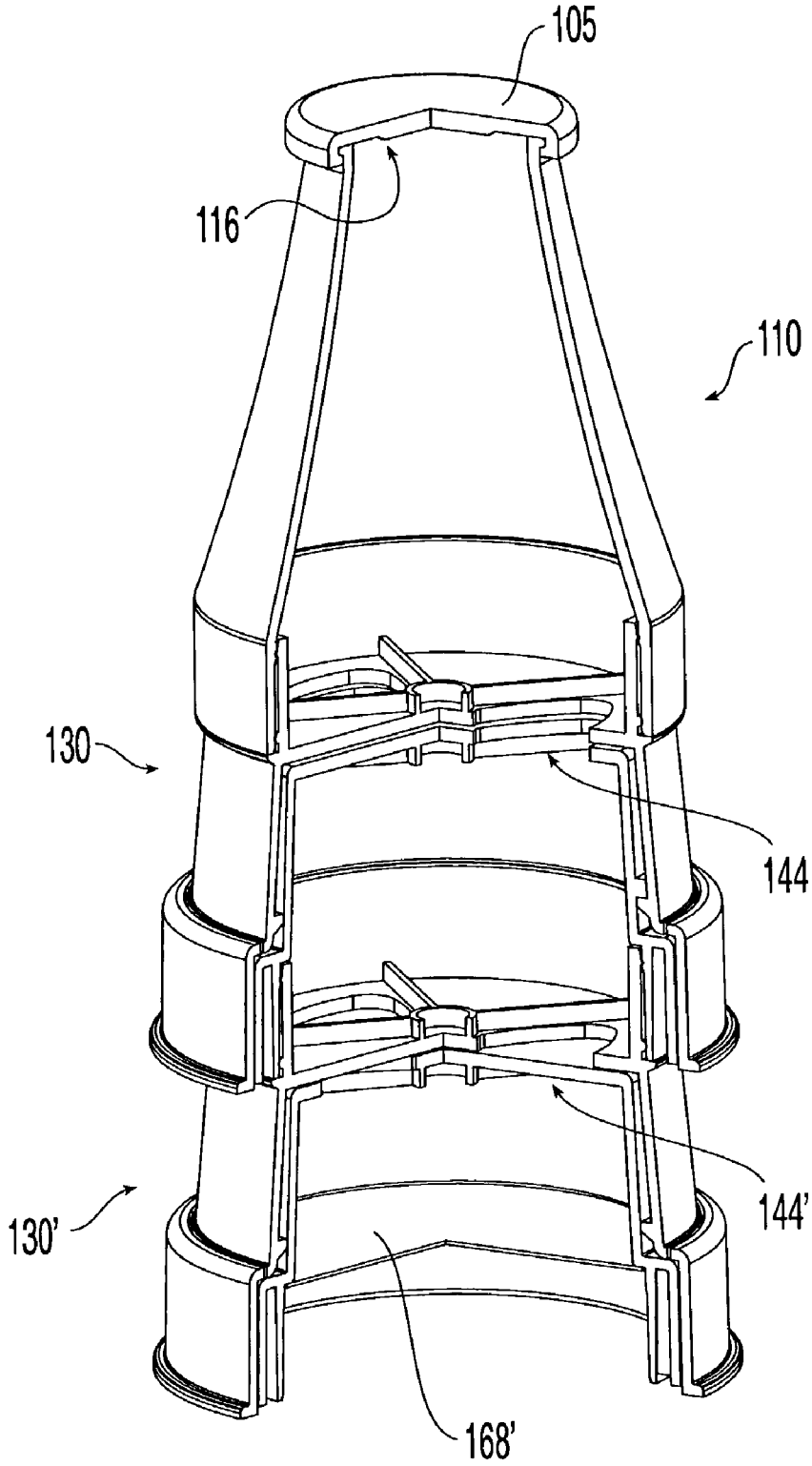
FIG. 19 is a partial cutaway drawing of container assembly of FIG. 18 with additional cartridge unit attached to the bottom of the first cartridge unit and, thus, illustrating a three-compartment container assembly.

FIG. 19 is a partial cutaway view of the container assembly of FIG. 18 with another cartridge unit 130' attached to first cartridge unit 130 thus forming a three-compartment container assembly similar to the assembly shown in FIG. 17. The container assembly is shown with displaceable member 144 of cartridge unit 130 in an unsealed position while displaceable member 144' of cartridge unit 130' is in a sealed position. The bottom opening of cartridge unit 130' may be sealed with a closure member 168' in the manner described in reference to FIG. 4.

Figure 20:
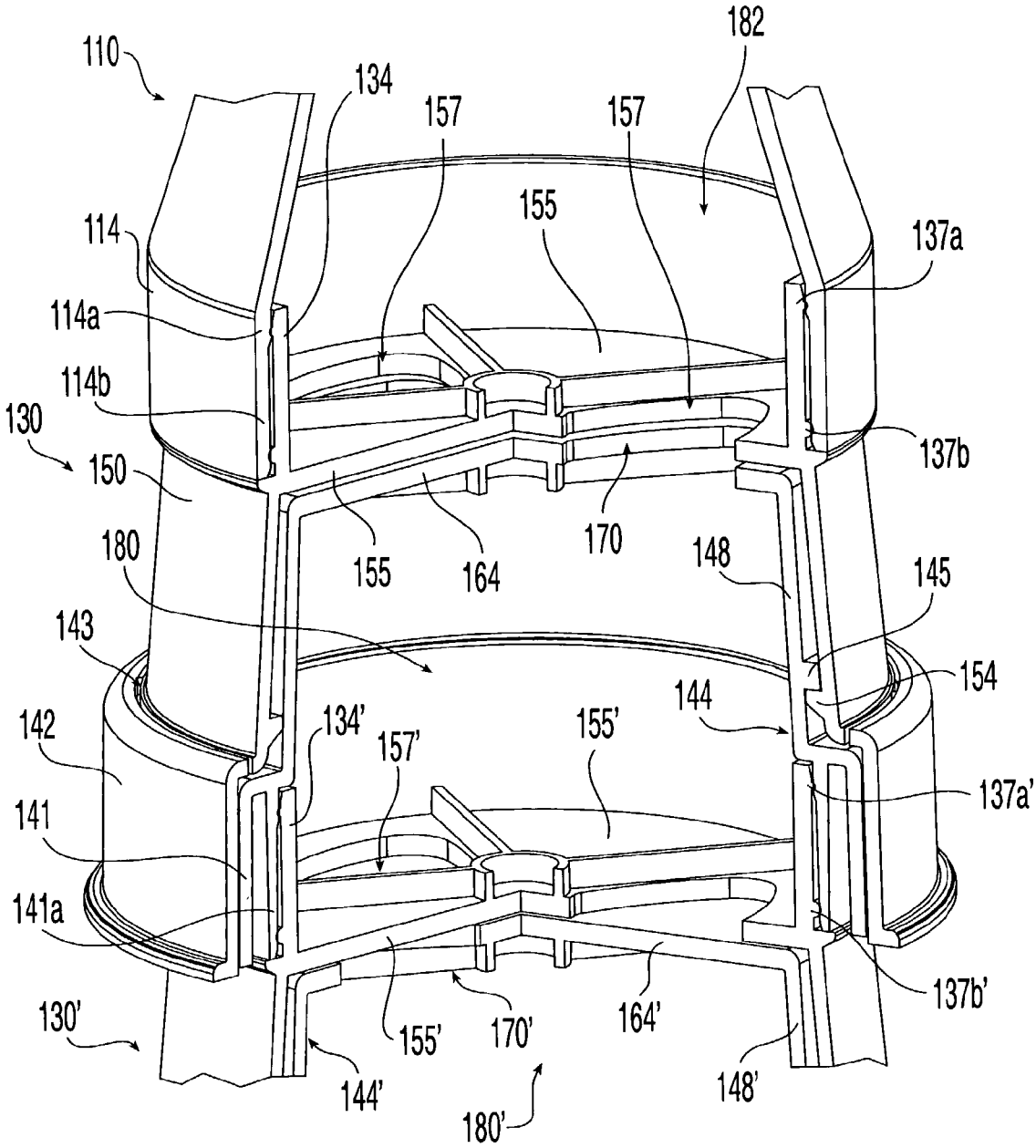
FIG. 20 is a detailed partial cutaway drawing of the container assembly of FIG. 19.

FIG. 20 is a detailed view of the container assembly of FIG. 19 showing detailed structure of the cartridge units of this embodiment. As shown here and also discussed in reference to FIG. 18, the fluid-tight seal between flange portion 114 of dispensing unit 110 and cartridge unit 130 is formed by sealing ridges 137*a* and 137*b* that sealingly engage the inside surface of flange portion 114. It is also to be appreciated that flange portion 114 is provided with a thick-walled section 114*a* and a thin-walled section 114*b* so that the manner in which sealing ridges 137*a* and 137*b* engage to form the fluid-tight seal is same as described in reference to the seal between flange portion 14 and sealing ridges 37*a* and 37*b* in FIG. 9. It is to be noted that at the bottom end of displaceable member 144 is provided a sealing flange 141*a* that cooperates with sealing ridges 137*a'* and 137*b'* of second cartridge unit 130'.

As mentioned in reference to FIG. 20, displaceable member 144 of cartridge unit 130 is in an unsealed position so that flow-openings 157 and 170 are in alignment and allow flow-communication between inside chamber 180 of cartridge unit 130 and the dispensing unit 110. Displaceable member 144' of cartridge member 130' is in a sealed position so that flow-openings 157' and 170' are not in alignment. Thus, top-end wall 155' and sealing wall 164' form a partition seal between inside chamber 180 of cartridge unit 130 and inside chamber 180' of cartridge unit 130'.

Based on the above descriptions of the basic assembly units including a dispensing unit and a cartridge unit, it is to be appreciated that one may assemble not only two or three-compartment containers but multi-compartment containers having several or more compartments by employing as many cartridge units as necessary and connecting them in series. It also is to be appreciated that a multi-compartment container may be assembled by connecting two or more cartridge units in series without any dispensing unit. Once the contents of the cartridges are mixed into a formulation, the formulation, whether it be a liquid or powder, may be dispensed through the end opening of one of the two terminally located cartridges. In other words, the mixed content may be dispensed through the top opening of the top cartridge or the bottom opening of the bottom cartridge. If a separate dispensing device were required by a particular application, an appropriate dispensing device may be attached to the opening of the dispensing cartridge.

Furthermore, another configuration of a multi-compartment container assembly includes one or more cartridge units attached to both open ends of a dispensing unit.

Figure 21:
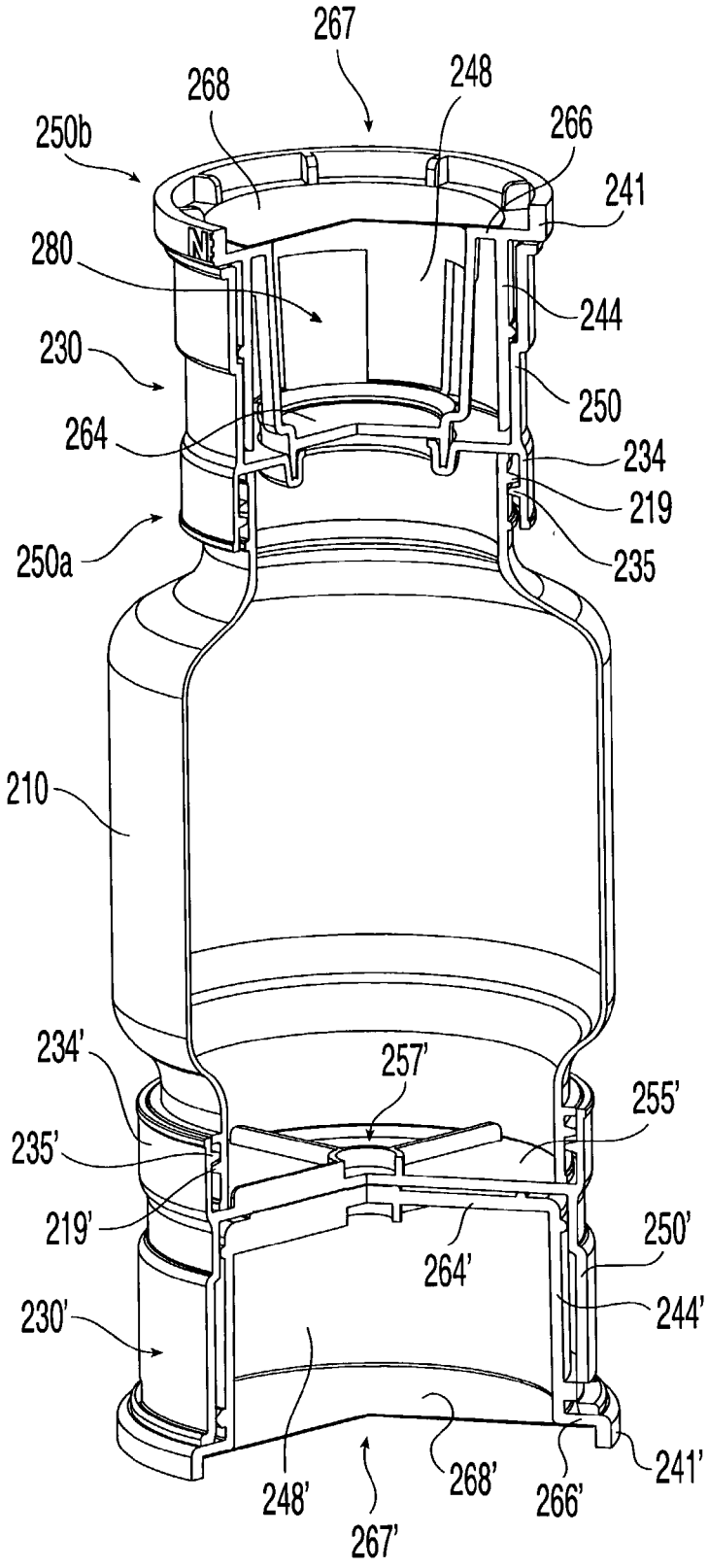
FIG. 21 is a cross-sectional view of another embodiment of the container assembly.

FIG. 21 illustrates an example of such an assembly configuration. Two cartridge units 230 and 230' are attached to each end of a dispensing unit 210. The cartridge units may be the type illustrated by cartridge unit 30 in FIGS. 8–11 or the type illustrated by cartridge unit 130 in FIGS. 18–20. However, it will be appreciated by one of ordinary skill in the art that the specific structures of the cartridge units used in the assembly system of the present invention are not limited to these two types of cartridge units.

Cartridge unit 230 has structures similar to cartridge unit 30 illustrated in FIGS. 8–11. But unlike cartridge unit 30, cartridge unit 230 and dispensing unit 210 are adapted and configured to threadably engage each other. Joining sleeve 234 at top end 250*a* of cartridge unit 230 and the top end opening of dispensing unit 210 are provided with screw threads 235 and 219, respectively so that cartridge unit 230 and dispensing unit 210 can be screwed together.

Cartridge unit 230 is provided with an axially displaceable member 244 having a sealing wall 264 at its top end, adapted and configured to sealingly engage cartridge housing 250, a user manipulable portion 241 at its bottom end, and at least one connecting member 248 connecting sealing wall 264 and user manipulable portion 241. When displaceable member 244 is in its sealed position, sealing wall 264 sealingly engages cartridge housing 250 near its top end 250*a* closing the cartridge unit's top opening. When displaceable member 244 is in its unsealed position, sealing wall 264 is disengaged from cartridge housing 250 allowing a flow-communication between inside chamber 280 of cartridge unit 230 and the exterior of the container.

At the bottom end 250*b* of displaceable member 244 is fillable opening 267 that may be sealed with a sealing membrane 268 by sealing the membrane to annular rim 266 by a suitable sealing method such as heat sealing.

Cartridge unit 230' sealingly engages the bottom opening of dispensing unit 210 and has structures similar to cartridge unit 130 illustrated in FIGS. 18–20. Cartridge unit 230' and dispensing unit 210 are also configured and adapted to threadably engage each other. Joining sleeve 234' and the bottom end opening of dispensing unit 210 are provided with screw threads 235' and 219', respectively so that cartridge unit 230' and dispensing unit 210 can be screwed together.

Cartridge unit 230' has a housing 250' with a top-end wall 255' provided with one or more flow-through openings 257'. A displaceable member 244' is provided within cartridge housing 250' and has a user manipulable portion 241' for rotationally moving displaceable member 244' between a sealed position and an unsealed position. User manipulable portion 241' of displaceable member 244' is connected to a sealing wall 264' by a side wall 248'. Sealing wall 264' of cartridge unit 230' is situated just below top-end wall 255' of the cartridge housing and has one or more flow-through openings. When sealing wall 264' is in its sealed position, flow-through openings 257' and the flow-through openings on sealing wall 264' do not align with each other so that the combination of sealing wall 264' and top-end wall 255' form a partitioning seal between dispensing unit 210 and cartridge unit 230'. When sealing wall 264' is in its unsealed position, flow-through openings 257' and the flow-through openings on the sealing wall 264' are aligned with each other and the openings establish a flow-communication between dispensing unit 210 and cartridge unit 230'. Bottom fillable opening 267' maybe sealed with a sealing membrane 268'. As discussed above in reference to sealing membrane 268 of cartridge unit 230, sealing membrane 268' may be sealed to annular rim 266 by a suitable sealing method such as heat sealing.

Accidental displacement of displaceable members 244 and 244' of cartridge units 230 and 230', respectively, can be prevented by utilizing the security ring structure similar to the one illustrated in conjunction with cartridge units 30, 30', 130, and 130' or other suitable mechanical means.

It would be appreciated by one of ordinary skill in the art that a plurality of the cartridge units described in this embodiment of the present invention can also be assembled in series at each end of dispensing unit 210 similar to the embodiments illustrated in FIGS. 15–17.

In another embodiment, the dispensing unit may be a bottle like container having only one opening. Again, one or more cartridge units may be attached in series to such a dispensing unit to assemble a multi-compartment container assembly according to the present invention.

Furthermore, according to the present invention, two or more cartridge units may be assembled serially to assemble a multi-compartment container. Each of the cartridge units in the assembly constitutes a sealed compartment holding a component of a formulation to be mixed. Once the contents of the container assembly have been mixed and are ready to be dispensed, the displaceable member of the upper-most cartridge unit in this assembly is moved to its unsealed position so that the mixed formulation can be dispensed through the top opening of the upper-most cartridge unit. If necessary, an appropriate dispensing device, such as a baby feeding nipple, can be attached to the top opening of the upper-most cartridge unit.

Another advantage of the multi-compartment assembly of the present invention is that each of the assembly units, whether it be a dispensing unit or a cartridge unit, can be filled with a component material and stored separately. And, an appropriate number of assembly units containing the appropriate component materials can be assembled into a multi-compartment assembly so that the contents of the assembly units can be mixed into a formulation and then dispensed directly from the assembly.

It will be appreciated that the above descriptions are intended only to serve as examples, and that many other embodiments are possible and encompassed within the spirit and the scope of the present invention. The assembly units, cartridge units and the dispensing units, described herein and illustrated in the figures are examples only.

Assembly units embodying other variations of the structures described here are within the scope of the present invention.

I claim:

1. A multi-compartment container assembly system comprising:

(a) a first fillable and sealable assembly unit, said first assembly unit including:

(i) a housing formed with a first and a second opening, said housing at least partially defining a contained volume, and (ii) two seals, one of said seals associated with said first opening, a second of said seals associated with said second opening, each said seal being secured to the associated opening, completely closing off the opening, so as to seal said contained volume, (b) a second assembly unit, fillable and sealable separately from said first assembly unit, said second assembly unit including:

(i) a housing formed with a first and a second opening, said housing at least partially defining a contained volume, (ii) a displaceable member having a sealing wall mechanically linked to an externally accessible manipulable portion, a displaceable member opening, and a displaceable member seal for being secured to said displaceable member opening to completely close off the opening, said displaceable member being movable within a peripheral wall of said housing and in sealing contact therewith, such that said displaceable member and said displaceable member seal said second opening in said housing, completely closing off said second opening, said sealing wall being displaceable between a sealing position, in which said sealing wall seals the first opening in said housing, and an unsealed position, wherein at least one of said openings of said first assembly unit, upon removal of its associated seal, is configured for sealing engagement with said first opening of said second assembly unit to form a two compartment container assembly, said contained volumes of said first and second assembly units being separated by said sealing wall when said sealing wall is in said sealing position, said manipulable portion being manually manipulable to displace said sealing wall from said sealing position to said unsealed position in which said contained volumes of said first and second assembly units are in flow-communication, such that each of said openings of said first assembly unit and each of said openings of said second assembly unit has a corresponding seal so that each of said first and second assembly units is separately fillable and sealable prior to assembly as a two compartment container.

2. The multi-compartment container assembly system of claim 1, wherein said displaceable member is in threaded engagement with said housing of said second assembly unit such that rotation of said displaceable member relative to said housing displaces said sealing wall from said sealing position to said unsealed position.

3. The multi-compartment container assembly system of claim 1, further comprising a detachable locking element associated with said displaceable member and said housing of said second assembly unit, said detachable locking element being deployed to prevent displacement of said displaceable member from said sealing position to said unsealed position until said detachable locking element is detached.

4. The multi-compartment container assembly system of claim 1, wherein said sealing wall has an annular projection and wherein said first opening of said second assembly unit has a complementary annular groove, said annular projection engaging said annular groove in said sealing position.

5. The multi-compartment container assembly system of claim 1, wherein at least one of said openings of said housing of said first assembly unit is implemented as a threaded neck for receiving a dispensing device.

6. The multi-compartment container assembly system of claim 1, wherein said second assembly unit is further configured for sealing interconnection with another similar assembly unit.

7. The multi-compartment container assembly system according to claim 1, wherein said displaceable member seal in said second assembly unit is a removable seal.

8. The multi-compartment container assembly system according to claim 1, wherein at least one of said seals of said first assembly unit is a removable seal.

9. The multi-compartment container assembly system according to claim 1, wherein the opening of said first assembly unit not configured for sealing engagement and said second opening of said second assembly unit are each separately openable for dispensing, when said two-compartment container is assembled.

10. The multi-compartment container assembly system of claim 1, wherein said displaceable member is in telescoping engagement with said housing of said second assembly unit.

* * * * *